US010317837B2

(12) United States Patent
Suenaga et al.

(10) Patent No.: US 10,317,837 B2
(45) Date of Patent: Jun. 11, 2019

(54) TONER COLLECTION CONTAINER AND IMAGE FORMING DEVICE INCLUDING THE SAME

(71) Applicant: KONICA MINOLTA, INC., Tokyo (JP)

(72) Inventors: Takenori Suenaga, Hachioji (JP); Hidehito Kishi, Tachikawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/025,756

(22) Filed: Jul. 2, 2018

(65) Prior Publication Data

US 2019/0011854 A1 Jan. 10, 2019

(30) Foreign Application Priority Data

Jul. 6, 2017 (JP) ..... 2017-132619

(51) Int. Cl.
*G03G 15/08* (2006.01)
*G03G 21/10* (2006.01)
*G03G 21/20* (2006.01)

(52) U.S. Cl.
CPC ..... *G03G 21/10* (2013.01); *G03G 15/0856* (2013.01); *G03G 15/0875* (2013.01); *G03G 21/206* (2013.01); *G03G 2215/0894* (2013.01)

(58) Field of Classification Search
CPC .. G03G 21/10; G03G 21/206; G03G 15/0856; G03G 2215/0894
See application file for complete search history.

(56) References Cited

U.S. PATENT DOCUMENTS

2016/0026119 A1* 1/2016 Ohashi ..... G03G 21/12 399/358
2016/0202636 A1* 7/2016 Koseki ..... G03G 21/105 399/358
2016/0202657 A1* 7/2016 Koseki ..... G03G 21/10 399/35
2017/0277079 A1* 9/2017 Ohashi ..... G03G 21/105

FOREIGN PATENT DOCUMENTS

JP H-05-066643 A 3/1993
JP 2016-045353 A 4/2016
JP 2016-138984 A 8/2016

* cited by examiner

*Primary Examiner* — Rodney A Bonnette
(74) *Attorney, Agent, or Firm* — Buchanan Ingersoll & Rooney

(57) ABSTRACT

A toner collection container detachably incorporated in an electrophotographic image forming device in order to collect toner to be discarded from an image former of the device includes: a housing including a hollow capable of storing discarded toner, and incorporated between an air inlet port and the image former in a space surrounded by a chassis of the image forming device; and at least one duct being formed of a cylindrical or tubular member that penetrates a storing region in the hollow of the housing from a side closer to the air inlet port to a side closer to the image former out of side walls of the housing, or formed of a recess included in a bottom surface of the housing and recessed toward the storing region, the duct guiding external air flowing from the air inlet port to a side where the image former is positioned.

15 Claims, 12 Drawing Sheets

TONER COLLECTION CONTAINER AND IMAGE FORMING DEVICE INCLUDING THE SAME

The entire disclosure of Japanese patent Application No. 2017-132619, filed on Jul. 6, 2017, is incorporated herein by reference in its entirety.

BACKGROUND

Technological Field

The present invention relates to an image forming device, and particularly relates to a structure of a toner collection container.

Description of the Related Art

An electrophotographic image forming device such as a laser printer, a copying machine, or a multifunction peripheral (MFP) generally has a toner collection container (refer to JP 2016-138984 A, JP 2016-045353A, and JP 05-066643A). The "toner collection container" represents a container in order that an electrophotographic image forming device may store toner removed from a photoreceptor or an intermediate transfer member mainly in a cleaning step. The image forming device forms a toner image on a surface of the photoreceptor and transfers the toner image directly from the photoreceptor to a sheet via the intermediate transfer member. Generally, the toner remains on the surfaces of the photoreceptor and intermediate transfer member after transfer, and a foreign matter such as paper dust adheres from the sheet. In the cleaning step, the image forming device scrapes off the above-described residual toner and foreign matter (hereinafter collectively referred to as "waste toner") from the surfaces of the photoreceptor and intermediate transfer member with a blade or a brush, and collects the waste toner in the toner collection container. The image forming device monitors an amount of such waste toner with a toner sensor (refer to JP 2016-138984 A and JP 2016-045353 A), and in a case of detecting that the toner collection container is full with the waste toner, a user is urged to replace the toner collection container by an indication on an operation panel or the like. Normally, a full toner collection container is disposable and discarded together with stored waste toner.

Preferably, a toner collection container has a large storable amount of waste toner. The larger the storable amount of waste toner is, the longer the image forming device is used before the container becomes full, and therefore, frequency of toner replacement is reduced and burden on a user required for replacing the container is reduced.

Preferably, a toner collection container is arranged inside a front face of an image forming device (refer to JP 2016-138984 A, for example). There may a case where optional devices such as a sheet feeding device and a post processing device are additionally provided on both sides of an image forming device, and therefore, in a case where the toner collection container is arranged inside the front face which is a place not hindered by such optional devices, a user can easily handle the container.

Additionally, it is necessary for a toner collection container not to hinder an airflow inside an image forming device. The image forming device introduces external air from a front face and exhausts internal air from a rear face by utilizing a built-in fan, for example. With such ventilation, for example, the image forming device diffuses, to the external air, ozone generated in a charging step and cools: a motor that drives a conveyance roller, a photoreceptor drum, an intermediate transfer belt, and the like; a control circuit of the motor; a heat generation member such as a fixing roller; and a power source. A ventilation passage (also referred to as an air duct) having a sufficiently large cross-sectional area is secured around the toner collection container such that the above-described effects provided by ventilation can be sufficiently obtained. For example, according to the image forming device disclosed in JP 05-066643 A, side walls of the toner collection container is also used as one face of a duct adapted to cool a light source.

Generally, a toner collection container has low strength against impact. The reason is that the container is usually disposable, and therefore, a typical material thereof is a material such as plastic or paper that can be easily treated after discarded. In a case where a user mistakenly slips a container out of the hand and drops the same on a floor at the time of replacement, an outer surface of the container subjected to direct impact of the floor is likely to be damaged, for example, dented or cracked. Furthermore, at the moment of collision with the floor, pressure (powder pressure) of stored waste toner rapidly is concentrated on a part of an inner face of the container close to the floor, and therefore, a boundary with other parts is likely to be damaged, for example, flawed.

The toner collection container is also easily deformed by weight of waste toner. Particularly, when a container has a longer length in one direction than in another direction, the container tends to be deflected in a longitudinal direction. The reason is that rigidity of a typical material thereof is low. In a case where the container is excessively deformed, a full-state detection error by the toner sensor of the image forming device may exceed an allowable range.

To prevent damage on the toner collection container by impact in a fall and to suppress the full-state detection error caused by deformation of the container within the allowable range, it is advisable to adopt, as a material of the container, a substance having high strength such as reinforced plastic or a metal. However, in this case, treatment after being discarded becomes difficult, and moreover, a low manufacturing cost can be hardly kept.

In recent years, it is further difficult to prevent a toner collection container from hindering an airflow inside an image forming device while keeping a sufficiently large storable amount of waste toner. The reason is that a ratio of a volume occupied by a toner collection container inside an image forming device is increased and a gap around the toner collection container is narrowed as a result of rapid progress in miniaturization of image forming devices along with wide spread use in small offices/home offices and households.

SUMMARY

An object of the present invention is to solve the above-described problems, and particularly to provide a toner collection container that: prevents damage by impact in a fall and deformation caused by the weight of the waste toner regardless of strength and rigidity of a material; and does not hinder an airflow inside an image forming device even while keeping a sufficiently large storable amount of waste toner.

To achieve the abovementioned object, according to an aspect of the present invention, there is provided a toner collection container detachably incorporated in an electrophotographic image forming device in order to collect toner to be discarded from an image former of the image forming device, and the toner collection container reflecting one aspect of the present invention comprises: a housing including a hollow capable of storing discarded toner, and incorporated between an air inlet port and the image former in a space surrounded by a chassis of the image forming device, the air inlet port introducing external air into the space; and at least one duct being formed of a cylindrical or tubular member that penetrates a storing region in the hollow of the housing from a side closer to the air inlet port to a side closer to the image former out of side walls of the housing, or formed of a recess included in a bottom surface of the housing and recessed toward the storing region, the storing region actually storing the toner, and the duct guiding external air flowing from the air inlet port to a side where the image former is positioned.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

[External View of Image Forming Device]

Figure 1A:
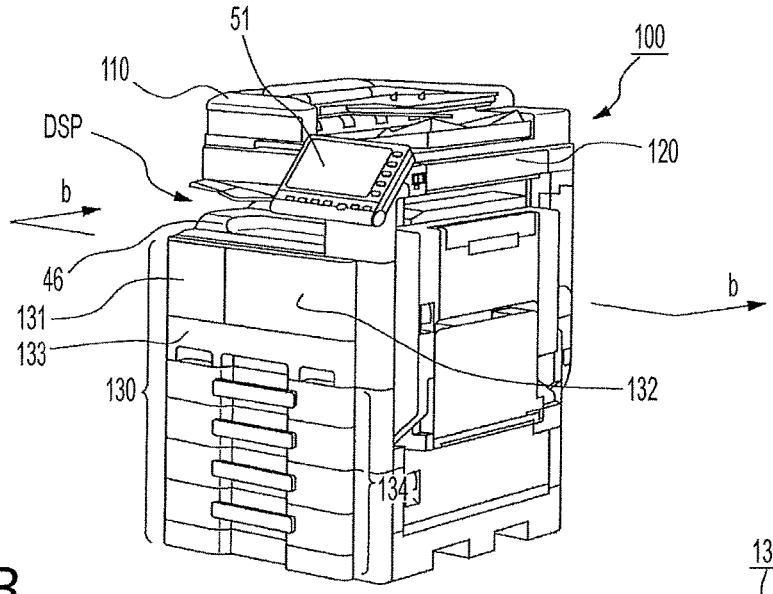
FIG. 1A is a perspective view illustrating an external view of an image forming device according to an embodiment of the present invention.

FIG. 1A is a perspective view illustrating an external view of an image forming device according to an embodiment of the present invention. The image forming device is a multi-function peripheral (MFP) 100 and has functions of a scanner, a color copy machine, and a color printer. An auto document feeder (ADF) 110 is mounted on an upper surface of a housing (hereinafter referred to as "body") of the MFP 100 in an openable manner. A scanner 120 is built in an upper part of the body positioned immediately below the ADF 110, and a printer 130 is built in a lower part of the body. Three front doors 131, 132, and 133 are attached to a front face in the upper part of the printer 130 in an openable manner, and a plurality of stages of sheet feeding cassettes is attached to a lower part 134 in a removable manner.

The MFP 100 is an internal sheet ejection type, and a sheet ejection tray 46 is installed in a gap DSP between the scanner 120 and the printer 130, and stores a sheet ejected from a sheet ejection port (not illustrated) located on a deeper side thereof. An operation panel 51 is attached to a part included in a front face of the body and positioned beside the gap DSP. The operation panel 51 has a front face embedded with a touch panel, and various mechanical push buttons are arranged around the touch panel.

[Structure of Printer]

Figure 1B:
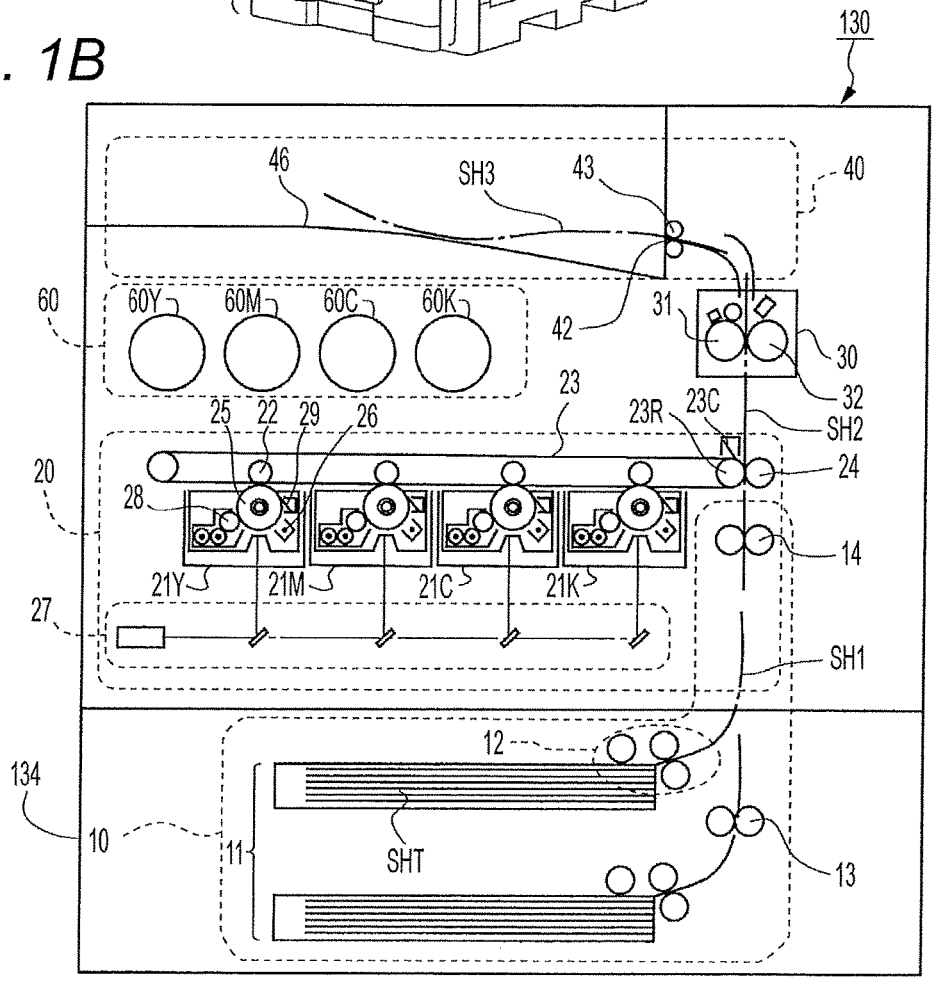
FIG. 1B is a front view schematically illustrating an internal structure of a printer included in the device.

FIG. 1B is a front view schematically illustrating an internal structure of the printer 130. Note that elements of the printer 130 are illustrated in a manner seen through the front face of the body in FIG. 1B. The printer 130 is an electrophotographic color printer, and includes a sheet feeder 10, an image former 20, a fixing unit 30, and an sheet ejector 40 in a space surrounded by a chassis (not illustrated) that supports the body. These elements 10 to 40 are cooperatively operated to form a color image on a sheet with toner on the basis of image data while conveying the sheet in the space surrounded by the chassis.

The sheet feeder 10 separates, one by one, a sheet SH1 from a bundle of sheets SHT stored in a sheet feeding cassette 11 by utilizing a group of conveyance rollers 12, 13, and 14, and feeds the sheet SH1 to the image former 20. A material of a sheet that can be stored in the sheet feeding cassette 11 includes paper and a resin, and types of the paper may include high quality paper, color paper, and coated paper. Sheet sizes include not only standard sizes specified by the JIS standard, such as A3 to A7 and B4 to B7, but also sizes of a business card, a bookmark, a ticket, a postcard, an envelope, and a photograph (L size). Sheet postures can be set in any one of longitudinal arrangement and lateral arrangement.

The image former 20 forms a toner image on a sheet SH2 conveyed from the sheet feeder 10. Specifically, in each of the four image forming units 21Y, 21M, 21C, and 21K, a photoreceptor drum 25 is rotated, and simultaneously electricity is discharged between an electric charger 26 and a surface thereof to charge the surface. Next, a charged part of the photoreceptor drum 25 is irradiated with laser light from an exposure unit 27. The exposure unit 27 changes an amount of laser light to be emitted to each different image forming unit on the basis of a gradation value of each different color out of gradation values of the four colors of yellow (Y), magenta (M), cyan (C), and black (K). Therefore, electrostatic latent images of different colors are formed on surfaces of different photoreceptor drums 25. Subsequently, toner that covers a surface of a developing roller 28 contacts the surfaces of the photoreceptor drums 25 to develop an electrostatic latent image on the surface thereof. In each of the different image forming units, there is toner of one different color out of Y, M, C and K, and therefore, toner images of Y, M, C, and K are formed one by one on the respective surfaces of the four photoreceptor drums 25. When each toner image passes through a nip between a photoreceptor drum 25 and a primary transfer roller 22, each image is transferred from the surface of the photoreceptor drum 25 to a surface of an intermediate transfer belt 23 by electric field therebetween. Thus, four single color toner images are transferred onto the intermediate transfer belt 23 in a superimposed manner, and one color toner image is formed. When this color toner image passes through a nip between a drive roller 23R of the intermediate transfer belt 23 and a secondary transfer roller 24, the color toner image is transferred by an electric field between the two rollers 23R and 24 to a surface of the sheet SH2 simultaneously made to pass through the same nip.

The fixing unit 30 thermally fixes the toner image on the sheet SH2 conveyed from the image former 20. Specifically, when this sheet SH2 is made to pass through a nip between a fixing roller 31 and a pressure roller 32, the fixing roller 31 applies heat of a built-in heater to the surface of the sheet SH2, and the pressure roller 32 presses the heated part of the sheet SH2 against the fixing roller 31 by applying pressure. The toner image is fixed on the surface of the sheet SH2 by the heat from the fixing roller 31 and the pressure from the pressure roller 32.

The sheet ejector 40 ejects a sheet SH3 conveyed from the fixing unit 30 from a sheet ejection port 42 by a sheet ejection roller 43, and stores the sheet SH3 in the sheet ejection tray 46.

Cleaner

A surface of each photoreceptor drum 25 contacts a cleaning blade 29 after contacting the primary transfer roller 22. The cleaning blade 29 is a thin long rectangular plate-like member made of a thermosetting resin such as polyurethane rubber, and has a length substantially equal that of the photoreceptor drum 25 (size in a normal direction of a sheet surface in FIG. 1B). An end face (edge) of the blade 29 extending in a longitudinal direction (in the normal direction of the sheet surface in FIG. 1B) obliquely contacts the surface of the photoreceptor drum 25, and scrapes residual toner and other foreign matters from surface of the photoreceptor drum 25 with rotation of the photoreceptor drum.

The surface of the intermediate transfer belt 23 contacts a cleaning blade 23C after passing through the nip between the drive roller 23R and the secondary transfer roller 24. The cleaning blade 23C is a thin long rectangular plate-like member made of a thermosetting resin such as polyurethane rubber, and has a length substantially equal to that of the intermediate transfer belt 23 (size in the normal direction of a sheet surface in FIG. 1B). An end face (edge) of the blade 23C extending in the longitudinal direction (in the normal direction of the sheet surface in FIG. 1B) obliquely contacts the surface of the intermediate transfer belt 23, and scrapes residual toner and foreign matters like paper dust from the surface of the intermediate transfer belt 23 with rotation of the intermediate transfer belt.

Toner Replenishing Unit

Figure 2A:
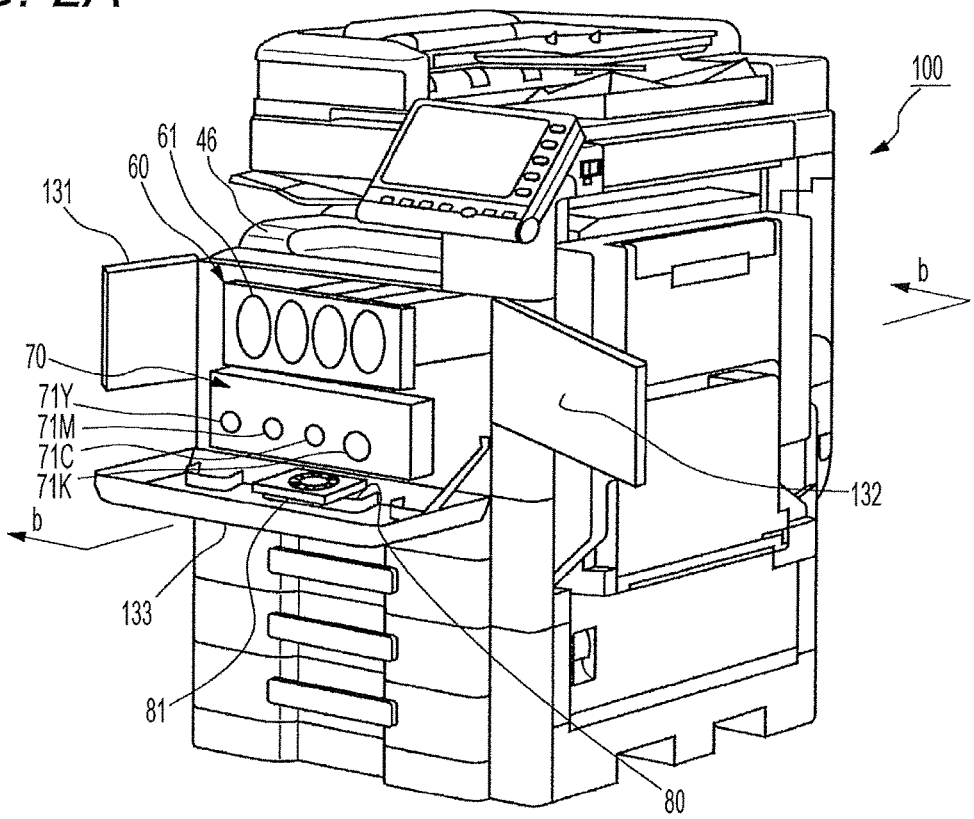
FIG. 2A is a perspective view illustrating an external view of the printer in a state in which front doors of a body of the image forming device illustrated in FIGS. 1A and 1B are opened.
Figure 2B:
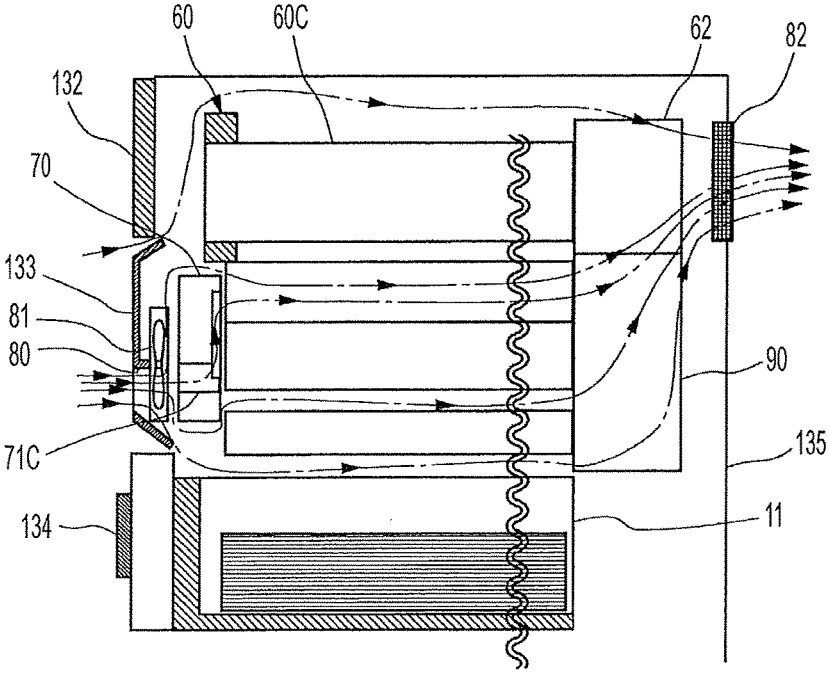
FIG. 2B is a schematic vertical cross-sectional view of the printer taken along a line b-b illustrated in FIG. 2A.

FIG. 2A is a perspective view illustrating an external view of the printer 130 in a state in which front doors 131 to 133 of the body of the MFP 100 are opened, and FIG. 2B is a schematic vertical cross-sectional view of the printer 130 taken along a line b-b illustrated in FIG. 2A. As illustrated in FIGS. 2A and 2B, a toner replenishing unit 60 is built in immediately below the sheet ejection tray 46 inside the body of the MFP 100. When the front doors 131 and 132 are opened, a front face of the replenishing unit 60 is exposed to the outside. Four toner bottles 60Y, 60M, 60C, and 60K can be freely inserted into and removed from four holes 61 opened on the front face. Each of the toner bottles 60Y to 60K has a thin long cylindrical shape and contains toner of one different color out of Y, M, C and K. In a deeper side of each hole 61 (on a right side in FIG. 2B), an end of an inserted toner bottle is rotatably held by a mechanism 62 of the replenishing unit 60. The mechanism 62 rotates each toner bottle around an axis thereof with a motor (not illustrated). Along with this rotation, the replenishing unit 60 captures toner spilled from each bottle, and conveys the toner to a developing roller 28 of each image forming unit by utilizing, for example, a screw.

Toner Collector

As further illustrated in FIGS. 2A and 2B, in a space immediately below the replenishing unit 60 inside the body of the MFP 100, the toner collection container 70 is incorporated between inner faces of the front doors 131 to 133 and the image former 20 in a detachable manner. Since the toner collection container 70 is exposed to the outside when the front doors 131 to 133 are opened, a user can easily handle the container 70. A toner collector (not illustrated) is installed on a rear side of the container 70. The collector is a mechanism such as a screw that conveys residual toner and foreign matters such as paper dust (hereinafter collectively referred to as "waste toner") from the image former 20 to the container 70, and causes the conveyed waste toner to flow into the container 70 from a hole on the rear face thereof. The waste toner is mainly collected by the cleaners in the image former 20, and in the example illustrated in FIG. 1B, the cleaner includes the cleaning blade 23C contacting the intermediate transfer belt 23 and the cleaning blade 29 included in each of the image forming units 21Y to 21K. A structure of the toner collection container 70 will be described more in detail later.

The collector further includes a toner sensor (not illustrated) in a region facing the rear face of the container 70 when the toner collection container 70 is incorporated in the printer 130. The toner sensor is, for example, an optical type, and monitors an interface between waste toner stored in the container 70 and internal air of the container 70, and when a height of the interface reaches an allowable upper limit, the toner sensor detects a full state of waste toner in the container 70. The toner sensor will be described more in detail later.

Ventilation Structure

FIGS. 2A and 2B also illustrate air inlet port 80, a fan 81, and an air outlet port 82. The air inlet port 80 is a hole opened on the front door 133 of the body of the MFP 100, and provides communication between an inner space of the body and the outside thereof. The fan 81 is installed inside the front door 133 of the body, particularly, on a deeper side of the air inlet port 80. The air outlet port 82 is a hole opened on the rear face 135 of the body of the MFP 100, and provides communication between the inner space of the body and the outside thereof. With rotation of the fan 81, the external air is introduced into the inside of the body from the air inlet port 80, and the air inside the body is exhausted to the outside from the air outlet port 82. With this structure, airflows directed from the air inlet port 80 to the air outlet port 82 are generated in the space inside the body, as indicated by one-dot chain lines in FIG. 2B. These airflows mainly pass through a space surrounded by the intermediate transfer belt 23 and a gap between the exposure unit 27 and the image forming units 21Y to 21K in the image former 20, and flow into a drive unit 90 installed between the image former 20 and the rear face 135 of the body. The drive unit 90 is an assembly of a motor and a control circuit thereof, and the motor drives the conveyance rollers 12 to 14 of the sheet feeder 10, the photoreceptor drums 25, the developing rollers 28, and the drive roller 23R of the intermediate transfer belt 23 illustrated in FIG. 1B. The airflow having passed through the drive unit 90 escapes from the air outlet port 82 to the external air. Since the airflow thus flows from the air inlet port 80 to the air outlet port 82, ozone generated due to discharge at the electric charger 26 is released to the external air, and the motor and the control circuit included in the drive unit 90 and the exposure unit 27 are cooled.

As illustrated in FIGS. 2A and 2B, the toner collection container 70 is incorporated in a gap between the air inlet port 80 and the image former 20. The gap between this container 70 and members surrounding the same, such as the replenishing unit 60, is narrow. However, the container 70 includes four ducts 71Y, 71M, 71C, and 71K. Each of the ducts 71Y to 71K penetrates the inside of the container 70 from a side closer to the air inlet port 80 to a side closer to the image former 20 out of side walls of the container 70. With this structure, each of the ducts 71Y to 71K guides the external air flowing from the air inlet port 80 to the space surrounded by the intermediate transfer belt 23 and the gap between the image forming units 21Y to 21K and the exposure unit 27. Since the ducts 71Y to 71K thus function as ventilation passages, a large amount of the external air flowing into the drive unit 90 through the image former 20 from the air inlet port 80 can be secured despite a fact that the gap around the toner collection container 70 is narrow. As a result, even in a case where the toner collection container 70 blocks a large part of the space inside the front door 133, both of an effect of removing ozone from the image former 20 by ventilation and an effect of cooling the drive unit 90 and the exposure unit 27 are sufficiently high.

[Structure of Toner Collection Container]

Figure 3A:
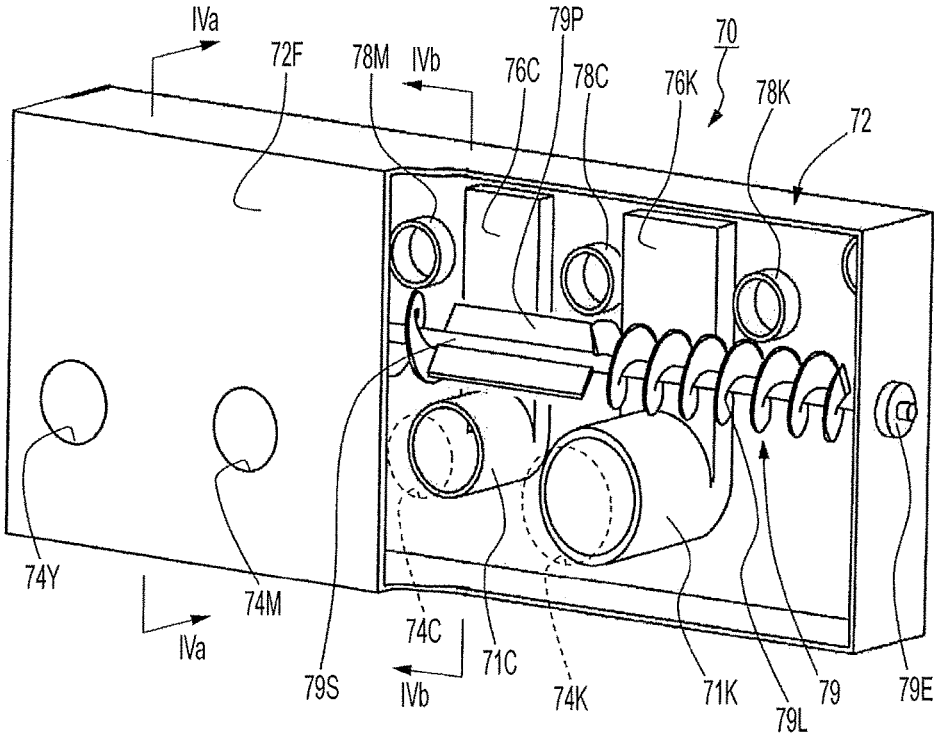
FIG. 3A is a perspective view illustrating an external view from a position where a front face of a toner collection container according to an embodiment of the present invention is visible.
Figure 3B:
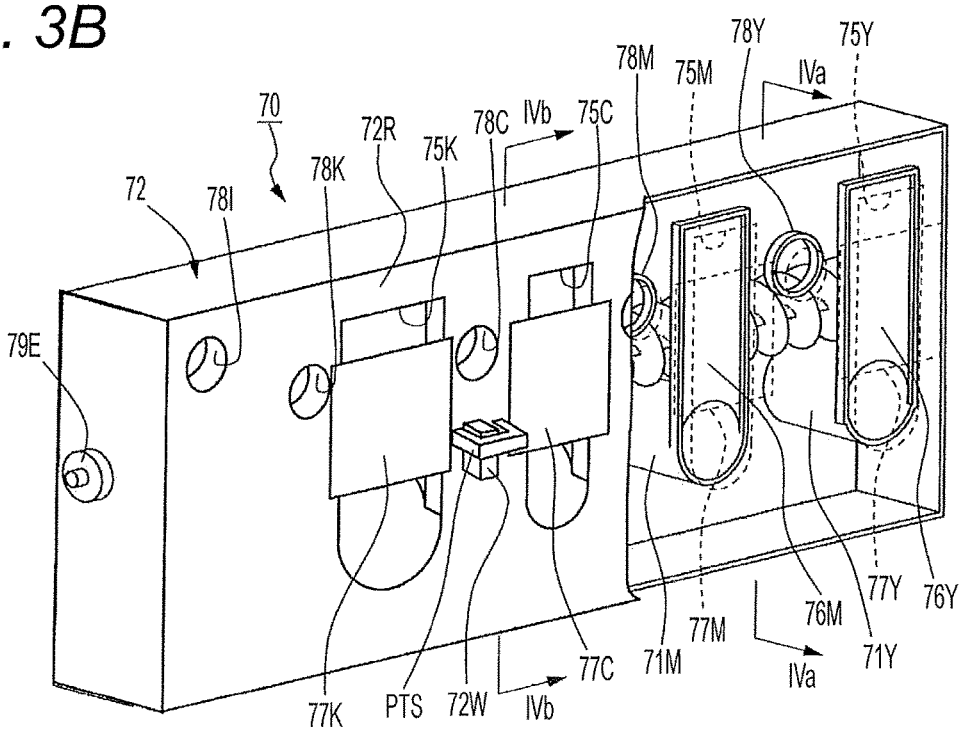
FIG. 3B is a perspective view illustrating an external view from a position where a rear face thereof is visible.
Figure 4A:
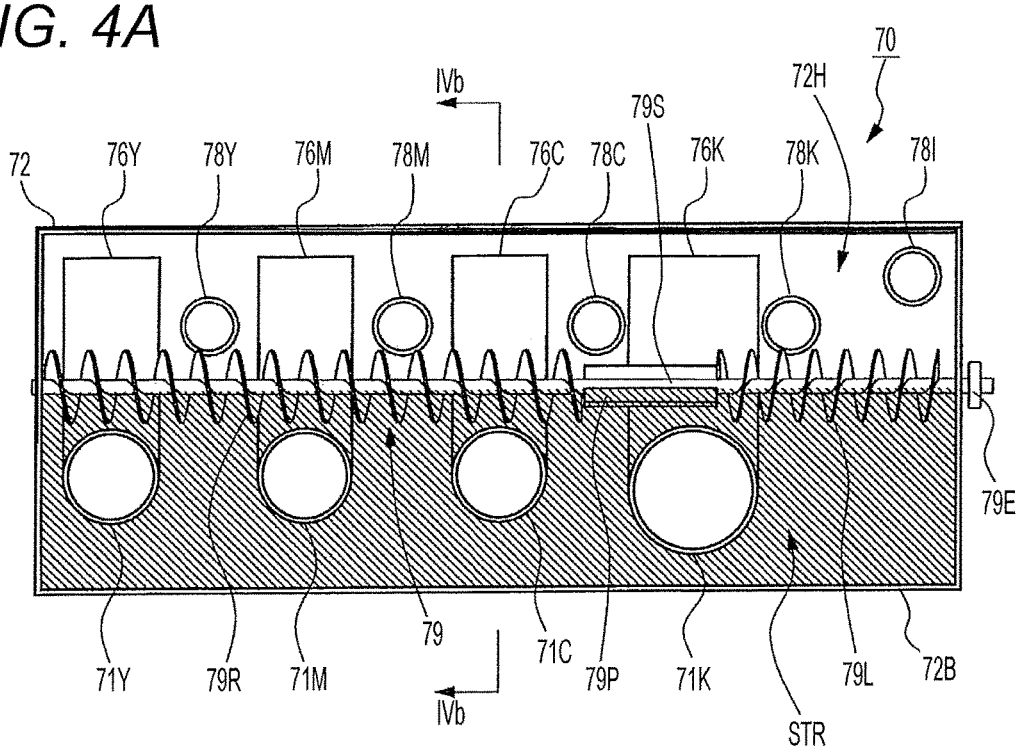
FIG. 4A is a vertical cross-sectional view of the container taken along a line IVa-IVa illustrated in FIGS. 3A and 3B.
Figure 4B:
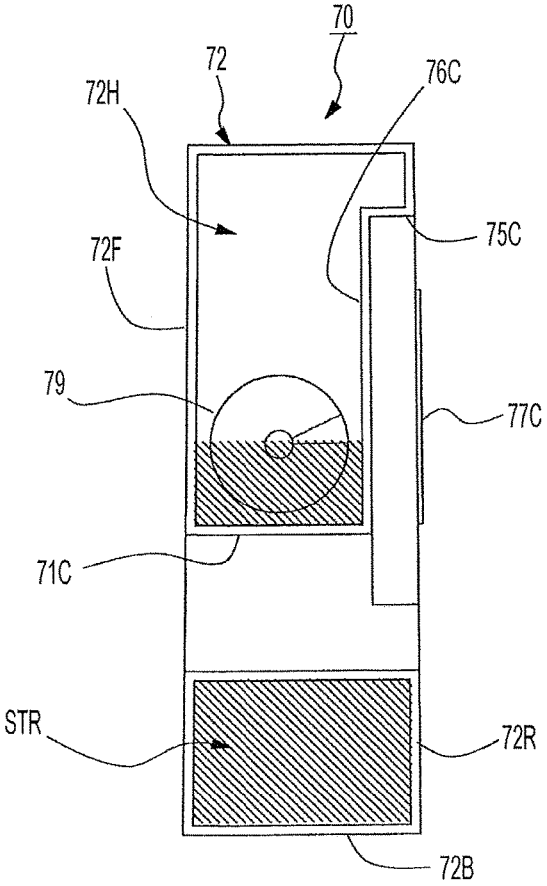
FIG. 4B is a vertical cross-sectional view of the container taken along a line IVb-IVb illustrated in FIGS. 3A and 3B.

FIG. 3A is a perspective view illustrating an external view from a position where a front face of the toner collection container 70 is visible, and FIG. 3B is a perspective view illustrating an external view from a position where a rear face thereof is visible. In FIGS. 3A and 3B, the front and rear faces of the container 70 are partially removed and an internal structure of the container 70 is visible. FIG. 4A is a vertical cross-sectional view of the container 70 taken along a line IVa-IVa illustrated in FIGS. 3A and 3B, and FIG. 4B is a vertical cross-sectional view of the container 70 taken along a line IVb-IVb illustrated in FIGS. 3A and 3B;

Housing

A housing 72 of the toner collection container 70 is, for example, a hollow rectangular plate-like member made of a thermoplastic resin such as polycarbonate that is easily reused, and has a longer length in one direction than in another direction. As illustrated in FIGS. 2A and 2B, a longitudinal direction of the housing 72 is horizontal inside the printer 130, and a front wall 72F and a rear wall 72R are parallel to the front face of the body. As illustrated in FIG. 3A, four round holes 74Y, 74M, 74C, and 74K are opened on the front wall 72F of the housing 72. Each of the round holes 74Y to 74K has a round circumference and is positioned in the vicinity of the fan 81 inside the printer 130 as illustrated in FIG. 2B. As illustrated in FIG. 3B, four vertical holes 75Y, 75M, 75C, and 75K are opened on the rear wall 72R of the housing 72. Each of the vertical holes 75Y to 75K has a rectangle shape having a long length in a short side direction of the rear wall 72R, and a lower end thereof is rounded like a semicircular shape. As illustrated in FIG. 2B, inside the printer 130, each of the lower ends of the vertical holes 75Y to 75K faces a different image forming unit out of the image forming units 21Y to 21K, and upper ends thereof face a space surrounded by the intermediate transfer belt 23.

Duct

As illustrated in FIG. 4B, each of the ducts 71Y to 71K has a cylindrical shape having a uniform radius in an axial direction, and extends perpendicular to the respective walls 72F and 72R from the front wall 72F close to the air inlet port to the rear wall 72R close to the image former 20 out of the side walls of the housing 72, and penetrates a hollow 72H inside the housing 72. Each of the ducts 71Y to 71K provides communication between one different round hole of the round holes 74Y to 74K and one different lower end of those of the vertical holes 75Y to 75K. With this structure, the ducts 71Y to 71K guide the external air introduced by the fan 81 from the round holes 74Y to 74K to the image forming units 21Y to 21K through the lower ends of the vertical holes 75Y to 75K. As illustrated in FIGS. 4A and 4B, the respective ducts are coaxial with the round holes and the semicircles at the lower ends of the vertical holes for which the ducts provide communication, and the ducts have radii same as those of the round holes and the semicircles. Particularly, the duct 71K, the round hole 74K, and the vertical hole 75K forming a ventilation passage to the image forming unit 21K for the color K have a cross-sectional area larger than the cross-sectional areas of the other ducts. With this structure, the air included in the external air introduced by the fan 81 and flowing through the duct 71K has a ratio of a flow rate larger than a ratio of a flow rate of the air that flows through each of other ducts 71Y to 71C. The reason is that: use frequency of the image forming unit 21K for the color K is higher than use frequency of the image forming units 21Y to 21C for other three colors Y, M and C, and therefore, an ozone generation amount and a heat generation amount in the motor or the like are large, and a large amount of ventilation is required in the image forming unit 21K.

Guide Passage

As illustrated in FIGS. 3A, 3B, 4A, and 4B, vertical walls 76Y, 76M, 76C, and 76K extend upward along an inner side of the rear wall 72R of the housing 72 respectively from connecting portions between the ducts 71Y to 71K and the lower ends of the vertical holes 75Y to 75K. The vertical walls 76Y to 76K block the vertical holes 75Y to 75K from the inner sides, and isolate the hollow 72H of the housing 72 from the outside, and also secure gaps inside the respective vertical holes. Regions between the upper ends and the lower ends of the vertical holes 75Y to 75K are blocked from the outside by thin plate-like members 77Y, 77M, 77C, and 77K each made of a resin, for example. With this structure, respective gaps between the plate-like members 77Y to 77K and the vertical walls 76Y to 76K illustrated in FIG. 4B function as guide passages to guide airflows sent from the fan 81 to the upper ends of the vertical holes 75Y to 75K from the ducts 71Y to 71K. The upper ends of the vertical holes 75Y to 75K face the space surrounded by the intermediate transfer belt 23, and the motor to drive the photoreceptor drums 25, the developing rollers 28, and drive roller 23R of the intermediate transfer belt 23, and the control circuit thereof are arranged in the drive unit 90 located in a deeper side of the space. The airflows having passed through the ducts 71Y to 71K are also branched into the guide passages (vertical walls) 76Y to 76K, and released from the upper ends of the vertical holes 75Y to 75K into the space surrounded by the intermediate transfer belt 23. With this structure, an air cooling effect for the motor of the drive unit 90 and the like can be highly maintained.

Receiving Port for Waste Toner

As illustrated in FIGS. 3A, 3B, and 4A, five penetration holes 78I, 78Y, 78M, 78C, and 78K are opened on an upper part of the rear wall 72R of the housing 72. All of the holes 78I to 78K have equal radii. The hole 78I located at an upper left corner of the rear wall 72R illustrated in FIG. 3B is located at a height higher than at heights of other four holes 78Y to 78K from a bottom surface 72B of the housing 72, and other four holes 78Y to 78K are located at the equal heights. Inside the printer 130, the hole 78I located at the upper left corner is connected to a storage chamber (not illustrated) of waste toner scraped by the cleaning blade 23C for the intermediate transfer belt, and the other four holes 78Y to 78K are connected to storage chambers (not illustrated) to store waste toner scraped by the cleaning blades 29 of the different image forming units, respectively. With this structure, the holes 78I to 78K function as receiving ports for waste toner from the intermediate transfer belt 23 and the image forming units 21Y to 21K. In the following, note that the waste toner receiving port 78I from the intermediate transfer belt 23 will be referred to as "color toner receiving port", and waste toner receiving ports 78Y to 78K from the image forming units 21Y to 21K for the respective single colors of Y, M, C and K will be referred to as "Y, M, C, K toner receiving ports".

Leveling Member

As illustrated in FIGS. 3A and 4A, the toner collection container 70 further includes a leveling member 79. The leveling member 79 is a movable member such as a screw or a paddle made of a resin or a metal, such as polypropylene, having high strength and processability. The leveling member 79 particularly includes a rotational shaft 79S, a paddle 79P, a right-handed screw 79R, and a left-handed screw 79L. The rotational shaft 79S penetrates the housing 72 in the longitudinal direction at a position slightly lower than the single color toner receiving ports 78Y to 78K, and is supported by both end surfaces in the longitudinal direction of the housing 72 in a manner rotatable around a center axis of its own. Inside the printer 130, one end 79E of the rotational shaft 79S receives torque from a motor inside the printer 130, and the rotational shaft 79S is rotated around the center axis of its own by this torque. The paddle 79P is a rectangular plate attached to a part included in an outer peripheral surface of the rotational shaft 79S and positioned substantially equal to the C toner receiving port 78C in the axial direction thereof, and has a plate surface radially expanding around the rotational shaft 79S. The right-handed screw 79R is a spiral-shaped blade extending in a manner winding clockwise on the outer peripheral surface of the rotational shaft 79S, and the left-handed screw 79L is a spiral-shaped blade extending in a manner winding anti-clockwise on the outer peripheral surface of the rotational shaft 79S. The right-handed screw 79R is positioned on a side provided with the Y, M, C toner receiving ports 78Y, 78M, 78C and the left-handed screw 79L is positioned on a side provided with the K toner receiving port 78K with respect to the paddle 79P. With rotation of the rotational shaft 79S, all of the paddle 79P, right-handed screw 79R, and left-handed screw 79L are rotated around the rotational shaft 79S in the same direction. With this rotation, the two screws 79R and 79L level, toward the paddle 79P, a top portion of mountain-like waste toner raised under the waste toner receiving ports 78I to 78K, and then the paddle 79P levels, toward the rear face of the housing 72, the mountain-like waste toner having been leveled by the screws 79R and 79L and gathered immediately below the paddle. With this action, the mountain-like waste toner is leveled, and a surface of the waste toner is leveled in the entire hollow 72H of the housing 72. As a result, the waste toner is actually stored in a region positioned lower than the leveling member 79 inside the hollow of the housing 72, namely, a region STR close to the bottom surface 72B of the housing 72 than the leveling member 79 is (refer to a hatched part illustrated in FIGS. 4A and 4B). Note that this region STR will be referred to as "storing region" in the following.

Bay Window for Full-State Detection

As illustrated in FIG. 3B, a bay window 72W protrudes rearward from the rear wall 72R of the housing 72. The bay window 72W is a hollow box-shaped protrusion, and a hollow inside thereof communicates with the hollow of the housing 72. The bay window 72W is positioned particularly below the C toner receiving port 78C at a height substantially same as that of the paddle 79P. With this structure, when the paddle 79P is rotated, the waste toner flows into the inside of the bay window 72W. The bay window 72W has high transparency for particularly an infrared ray or visible light. Inside the printer 130, the bay window 72W faces a toner sensor PTS provided in the printer 130. The toner sensor PTS is, for example, a transmissive photosensor, and includes a light emitter and a light receiver in each of two arms protruding in a U shape. The bay window 72W is arranged on a light ray from the light emitter to the light receiver between these arms. While the inside of the bay window 72W is empty, the infrared ray or visible light emitted from the light emitter passes through the bay window 72W and is detected by the light receiver. When a certain amount or more of waste toner is stored inside the bay window 72W, the waste toner interrupts the infrared ray or visible light emitted from the light emitter, and hinders detection by the light receiver. When the storing region STR of the housing 72 is full of the waste toner, the certain amount is equal to an amount of waste toner that has flown into the inside of the bay window 72W. Therefore, whether the storing region STR of the housing 72 is full with waste toner can be determined by whether the infrared ray or visible light from the light emitter is detected by the light receiver.

Strength and Rigidity of Toner Collection Container

A manufacturing process of the toner collection container 70 includes, for example, following steps. First, the front wall 72F and the rear wall 72R of the housing 72 are formed separately from thermoplastic resins by a unit of injection molding or the like. In this step, the ducts 71Y to 71K are integrally molded with the front wall 72F, and the vertical walls 76Y to 76K are integrally molded with the rear wall 72R. Next, the front wall 72F and the rear wall 72R are welded to each other with the leveling member 79 incorporated therebetween. Particularly, the ducts 71Y to 71K are welded to the rear wall 72R while penetrating the storing region STR in the hollow of the housing 72. With this structure, the ducts 71Y to 71K serve as "beams" in the structure of the housing 72, and therefore, the storing region STR has strength higher than that in other parts of the housing 72. Specifically, even in a case where a user mistakenly slips the container 70 out of the hand and drops the same on a floor at the time of replacing the toner collection container 70, a powder pressure of waste toner caused by collision with the floor is prevented from being concentrated only on the inner surface of the housing 72 but is dispersed to the ducts 71Y to 71K. As a result, damage on the inner surface of the housing 72 caused by rapid concentration of the powder pressure is prevented.

Furthermore, the bay window 72W is interposed between the two ducts 71C and 71K. Due to presence of these two ducts 71C, 71K, the vicinity of the bay window 72W has rigidity higher than that in other parts of the housing 72 do. Specifically, even in a case where distribution of waste toner stored inside the housing 72 is non-uniform, the ducts 71Y to 71K prevent deformation of the housing 72 caused by the weight of the waste toner, and particularly, the vicinity of the bay window 72W is prevented from being deflected in the longitudinal direction of the housing 72. As a result, inside the printer 130, the position of the bay window 72W with respect to the toner sensor PTS is kept correctly on the light ray from the light emitter to the light receiver. Thus, a full-state detection error caused by the toner sensor PTS is surely kept within the allowable range.

Advantages of Embodiment

As described above, the toner collection container 70 according to the embodiment of the present invention has the housing 72 incorporated between the air inlet port 80 and the image former 20 of the printer 130. The four ducts 71Y to 71K penetrate the storing region STR inside the housing 72 from the front wall 72F to the rear wall 72R of the housing 72, and guide the external air flowing from the air inlet port 80 to the side where the image former 20 is positioned. Since the ducts 71Y to 71K function as the "beams" in the structure of the housing 72, the housing 72 has high strength and rigidity regardless of strength and rigidity of a material thereof. Thus, the toner collection container 70 prevents damage by impact in a fall and deformation caused by the weight of the waste toner regardless of the strength and rigidity of the material, and does not hinder an airflow inside the printer 130 even while keeping a sufficiently large storable amount of waste toner.

MODIFIED EXAMPLES (A) The image forming device 100 illustrated in FIGS. 1A and 1B is a color print compliant MFP. The image forming device according to the embodiment of the present invention may also be a monochrome MFP dedicated to monochrome or a single function machine such as a printer, a copier, or a facsimile machine.

(B) An outer shape of the housing 72 of the toner collection container 70 illustrated in FIGS. 3A, 3B, 4A, and 4B is merely an example, and may be changed in accordance with a shape of a surrounding member inside the printer 130, or may be changed for user friendliness. Similarly, a duct shape is not limited to the cylindrical shapes of the ducts 71Y to 71K in which radii are uniform in the axial direction, and may be a shape having an elliptical or polygonal cross-section. As far as a duct has a structure penetrating the storing region, strength of the storing region can be kept sufficiently high without hindering an airflow inside the printer 130 regardless of the details of the outer shape of the housing and the details of the duct shape.

(C) In FIGS. 3A, 3B, 4A, and 4B, the duct 71K forming a ventilation passage to the image forming unit 21K for the color K has the cross-sectional area larger than the cross-sectional areas of other ducts 71Y to 71C. Thus, the cross-sectional areas may be different between the four ducts 71Y to 71K.

Figure 5A:
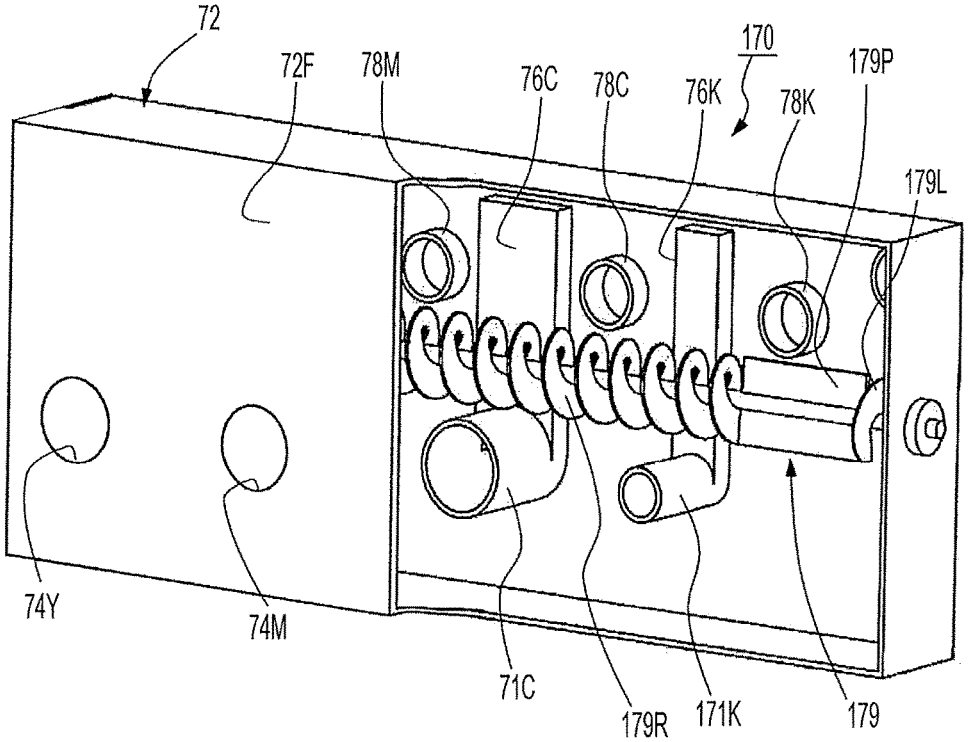
FIG. 5A is a perspective view illustrating an external view from a position where a front face of a first modified example of the toner collection container according to the embodiment of the present invention is visible.
Figure 5B:
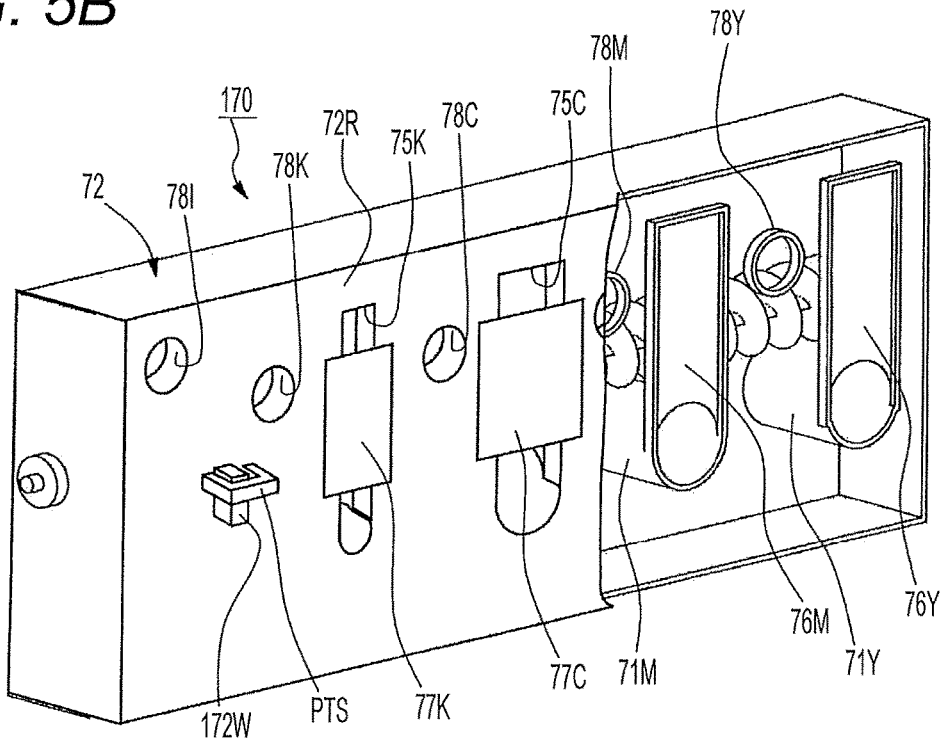
FIG. 5B is a perspective view illustrating an external view from a position where a rear face thereof is visible.

FIG. 5A is a perspective view illustrating an external view from a position where a front face of a first modified example of a toner collection container 170 according to the embodiment of the present invention is visible, and FIG. 5B is a perspective view illustrating an external view from a position where a rear face thereof is visible. In FIGS. 5A and 5B, the front and rear faces of the container 170 are partially removed and an internal structure of the container 170 is visible. The container 170 of the first modified example differs from the container 70 of the above-described embodiment in a position of the bay window for full-state detection, a cross-sectional area of each duct, and a structure of the leveling member. Since other elements are similar, the bay window, duct, and leveling member will be described below, and as for other elements, the description of the above embodiment will be used.

As illustrated in FIG. 5B, a bay window 172W protrudes rearward from the rear wall 72R of the housing 72. The bay window 172W has a structure in which a height from the bottom surface 72B of the housing 72 is similar to the bay window 72W illustrated in FIG. 3B. However, a position of the bay window 172W in the longitudinal direction of the housing 72 is positioned between the color toner receiving port 78I and the K toner receiving port 78K, and is particularly close to the end face in the longitudinal direction of the housing 72. Since a paddle 179P is arranged in front of this bay window 172W, a leveling member 179 has a longer right-handed screw 179R and a shorter left-handed screw 179L than those of the leveling member 79 illustrated in FIG. 4A. In a case where rigidity in the vicinity of the end face in the longitudinal direction of the housing 72 is already sufficiently high because the bay window 172W is located close thereto, a cross-sectional area of a duct 171K located closest to the bay window 172W may be designed to be smaller than cross-sectional areas of other ducts 71Y to 71C. The smaller a cross-sectional area of a duct is, the more increased a storable amount of waste toner is in the surrounding region. Additionally, since a mountain-like shape of waste toner stored in the surrounding region is hardly distorted, a correspondence relation between the amount of waste toner stored inside the bay window 172W and the amount of waste toner inside the storing region STR is hardly varied, and a full-state detection error by the toner sensor PTS hardly exceeds the allowable range.

(D) In FIGS. 3A, 3B, 4A, and 4B, the guide passages (vertical walls) 76Y to 76K of the toner collection container 70 are perpendicular to the longitudinal direction of the housing 72. With this structure, airflows having passed through the ducts 71Y to 71K are released from the same positions in the longitudinal direction of the housing 72 to the space surrounded by the intermediate transfer belt 23 and to the image forming units 21Y to 21K. Not limited thereto, the guide passage can be freely modified in accordance with a position where an airflow is to be released.

Figure 6A:
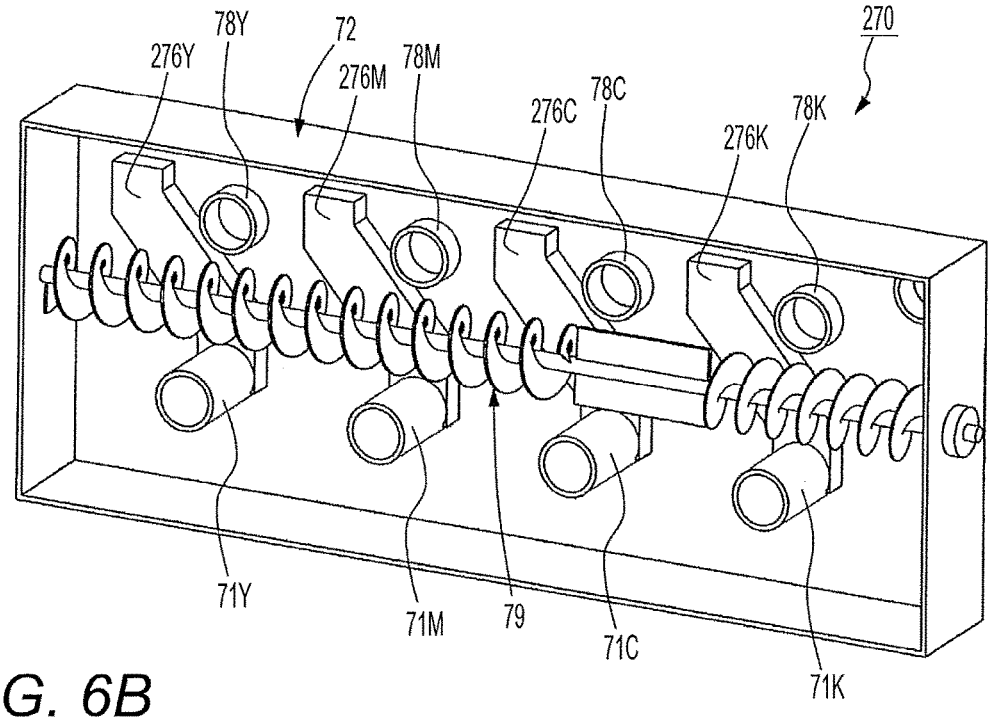
FIG. 6A is a perspective view illustrating an external view from a position where a front face of a second modified example of the toner collection container according to the embodiment of the present invention is visible.
Figure 6B:
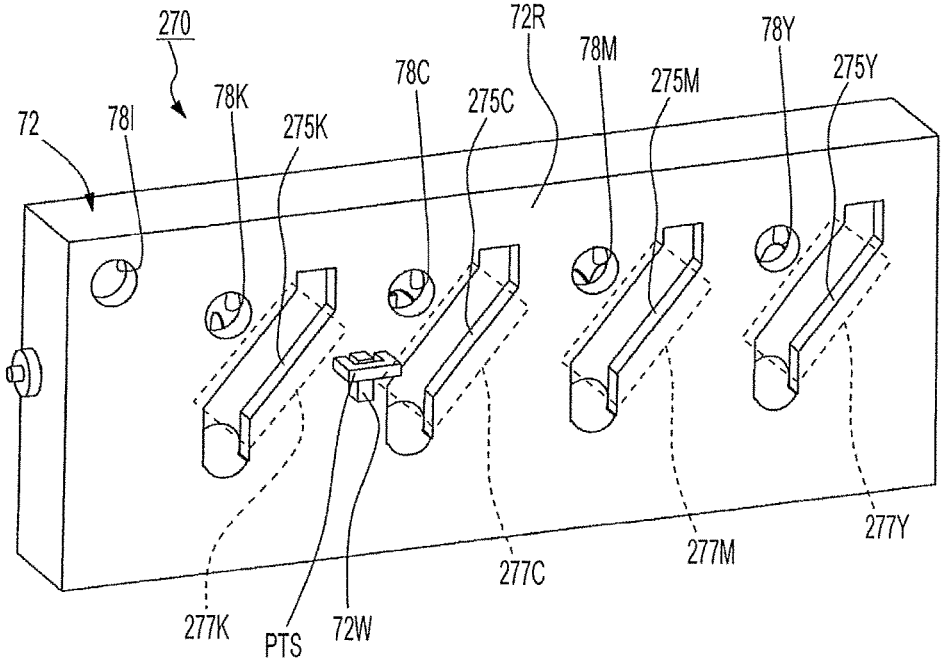
FIG. 6B is a perspective view illustrating an external view from a position where a rear face thereof is visible.

FIG. 6A is a perspective view illustrating an external view from a position where a front face of a second modified example of a toner collection container 270 according to the embodiment of the present invention is visible, and FIG. 6B is a perspective view illustrating an external view from a position where a rear face thereof is visible. In FIG. 6A, an entire front face of the container 270 is removed, and an internal structure of the container 270 is visible. The container 270 of the second modified example differs from the container 70 of the above-described embodiment in that: the cross-sectional areas of the four ducts 71Y to 71K are equal; and guide passages (vertical walls) 276Y to 276K have different shapes. Since other elements are similar, the guide passages (vertical walls) will be described below, and as for other elements, the description of the above embodiment will be used.

As illustrated in FIG. 6B, four vertical holes 275Y to 275K are formed in the rear wall 72R of the housing 72. Similar to the vertical holes 75Y to 75K illustrated in FIG. 3B, each of lower ends of the vertical holes 275Y to 275K faces a different image forming unit out of the image forming units 21Y to 21K, and upper ends thereof face the space surrounded by the intermediate transfer belt 23. However, different from the vertical holes 75Y to 75K illustrated in FIG. 3B, each of the vertical holes 275Y to 275K has an intermediate part inclined with respect to a height direction of the housing 72, and each of the intermediate portions connects each of the upper ends to each of the lower ends. With this structure, the respective lower ends of the vertical holes 275Y to 275K are positioned at positions substantially equal to the single color toner receiving ports 78Y to 78K but the respective upper ends are positioned in middle positions between the single color toner receiving ports 78Y to 78K in the longitudinal direction of the housing 72.

As illustrated in FIG. 6A, vertical walls 276Y to 276K extend upward along the inner side of the rear wall 72R of the housing 72 from respective connecting portions between the ducts 71Y to 71K and the lower ends of the vertical holes 275Y to 275K, and block the vertical holes 275Y to 275K from the inside. On the other hand, thin resin plate-like members 277Y to 277K each made of, for example, a resin block respective regions between the upper ends and the lower ends from the outside of the vertical holes 275Y to 275K. With this structure, a gap between each of the vertical walls 276Y to 276K and each of the plate-like members 277Y to 277K, namely, a guide passage guides an airflow from each of the ducts 71Y to 71K to each of the upper ends of the vertical holes 275Y to 275K. Since the intermediate parts of the guide passages (vertical walls) 276Y to 276K are inclined with respect to the height direction of the housing 72, positions from which airflows having passed through the ducts 71Y to 71K are released to the space surrounded by the intermediate transfer belt 23 and to the image forming units 21Y to 21K are different in the longitudinal direction of the housing 72. These positions can be adjusted in accordance with arrangement of the motor and the control circuit thereof in the deeper side of the space surrounded by the intermediate transfer belt 23 so as to keep a high cooling air effect for the motor and the control circuit thereof.

(E) In FIGS. 3A, 3B, 4A, and 4B, the ducts 71Y to 71K connect the round holes 74Y to 74K on the front face of the toner collection container 70 to the rear vertical holes 75Y to 75K in a one-to-one relation. With this structure, the external air flowing into the different round holes is released separately from the different vertical holes 75Y-75K without being joined. Not limited thereto, the housing 72 may include a structure in which airflows having passed through the different ducts are joined.

Figure 7A:
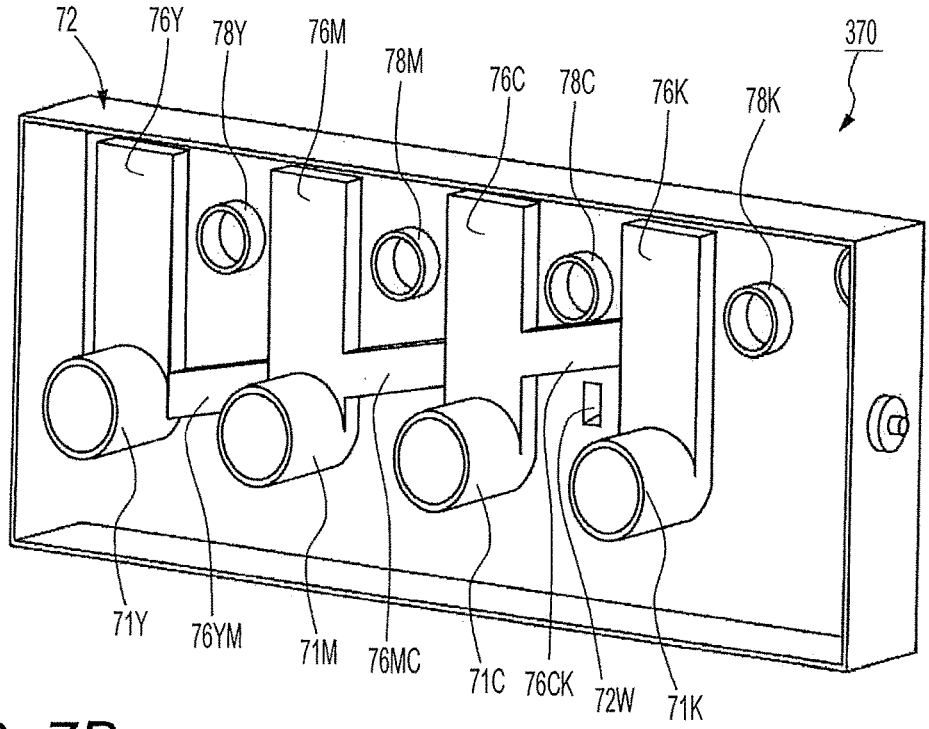
FIG. 7A is a perspective view illustrating an external view from a position where a front face of a third modified example of the toner collection container according to the embodiment of the present invention is visible.
Figure 7B:
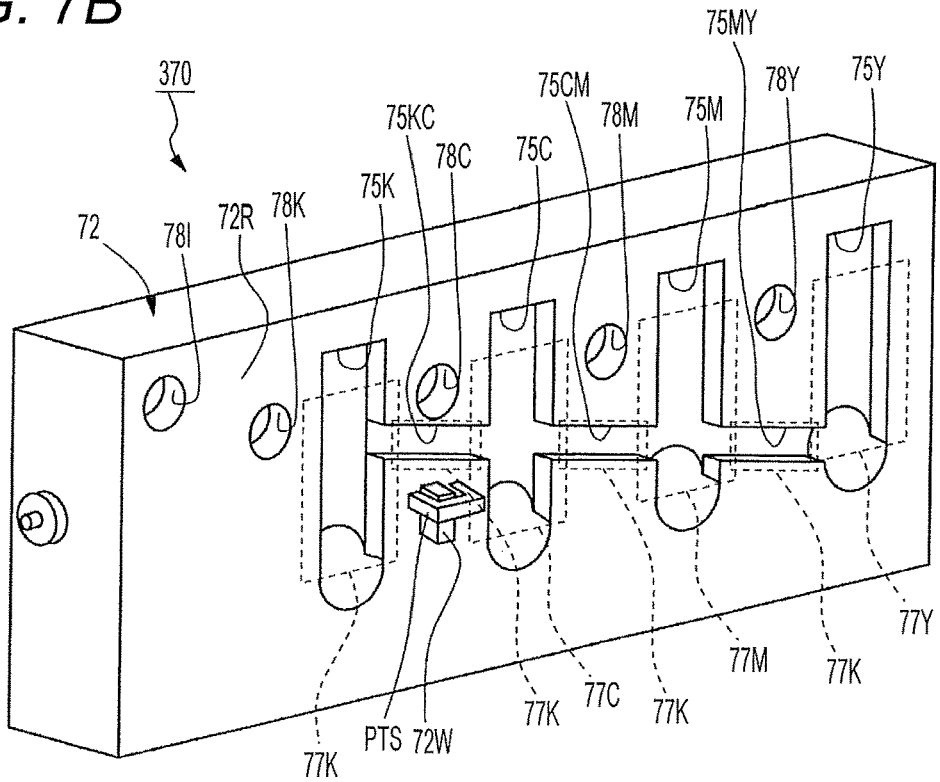
FIG. 7B is a perspective view illustrating an external view from a position where a rear face thereof is visible.

FIG. 7A is a perspective view illustrating an external view from a position where a front face of a third modified example of a toner collection container 370 according to the embodiment of the present invention is visible, and FIG. 7B is a perspective view illustrating an external view from a position where a rear face thereof is visible. In FIG. 7A, the entire front face of the container 370 and the leveling member are removed, and a structure of the rear wall 72R of the housing 72 is visible. The container 370 of the third modified example differs from the container 70 of the above embodiment in that: sizes of the four vertical holes 75Y to 75K are equal; and the rear wall 72R of the housing 72 includes communication passage to provide communication between different guide passages. Since other elements are similar, the communication passages will be described below, and as for other elements, the description of the above embodiment will be used.

As illustrated in FIG. 7B, cutouts 75KC, 75CM, and 75MY extend between the vertical holes 75K to 75Y on the rear wall 72R of the housing 72. These cutouts 75KC to 75MY are arranged in a straight line that connects, in an oblique direction relative to the longitudinal direction of the housing 72, regions between the vicinity of the upper end of the vertical hole 75K closest to the K toner receiving port 78K and the lower end of the farthest vertical hole 75Y, and the cutouts have a constant width in entire parts thereof. As illustrated in FIG. 7A, an inner side of each of the cutouts 75KC to 75MY is blocked by each of expansion walls 76YM, 76MC, and 76CK that respectively connect regions between the vertical walls 76Y to 76K. On the other hand, the outer side of each of the cutouts 75KC to 75MY is blocked by each of thin plate-like members 77KC, 77CM, and 77MY each made of a resin, for example. With this structure, respective gaps between the expansion walls 76CK to 76YM and the plate-like members 77KC to 77MY function as communication passages to provide communication between different guide passages. Particularly, since each communication passage is inclined with to the longitudinal direction of the housing 72, an airflow is branched to an adjacent guide passage (vertical wall) 76M from the lower end of the vertical hole 75Y farthest from the K toner receiving port 78K, subsequently the airflow is branched to an adjacent guide passage (vertical wall) 76C from the guide passage (vertical wall) 76M, and then the airflow is branched further to an adjacent guide passage (vertical wall) 76K from the guide passage (vertical wall) 76C. Although not illustrated in FIGS. 7A and 7B, valves that further branch, to the communication passages from the ducts 71Y to 71K, the airflows having been branched to the guide passages (vertical walls) 76Y to 76K from the ducts 71Y to 71K may be installed at respective intersections between the communication passages and the guide passages (vertical walls) 76Y to 76K. Thus, branched airflows from other three guide passages (vertical walls) 76Y to 76C are added to the airflow flowing through the guide passage (vertical wall) 76K closest to the K toner receiving port 78K. With this structure, a ratio of a flow rate of the air that flows through the duct is 71K, out of external air introduced by the fan 81, is larger than a ratio of a flow rate of the air flowing through each of other ducts 71Y to 71C. As a result, more airflows flow into the image forming unit 21K for the color K, which is most frequently used, than airflows flowing into other image forming units 21Y to 21C, and therefore, the ventilation effect such as the air cooling effect is kept high.

(F) In FIGS. 3A, 3B, 4A, and 4B, the ducts 71Y to 71K penetrate the storing region STR in the hollow of the toner collection container 70, and connect the round holes 74Y to 74K on the front face to the vertical holes 75Y to 75K on the rear face. With this structure, the ducts 71Y to 71K serve as the "beams" in the structure of the housing 72 of the container 70, and therefore, the storing region STR has strength higher than that in other parts of the housing 72. Furthermore, a duct may also be formed on an outer surface of the housing, particularly, on a part included in the bottom surface thereof and recessed toward the storing region. Due to presence of this duct, the bottom surface has strength higher than that in other parts of the housing, and therefore, even in a case where the container is subjected to direct impact from a floor when dropped on the floor, and the bottom surface is prevented from being damaged such as dented or cracked.

Figure 8A:
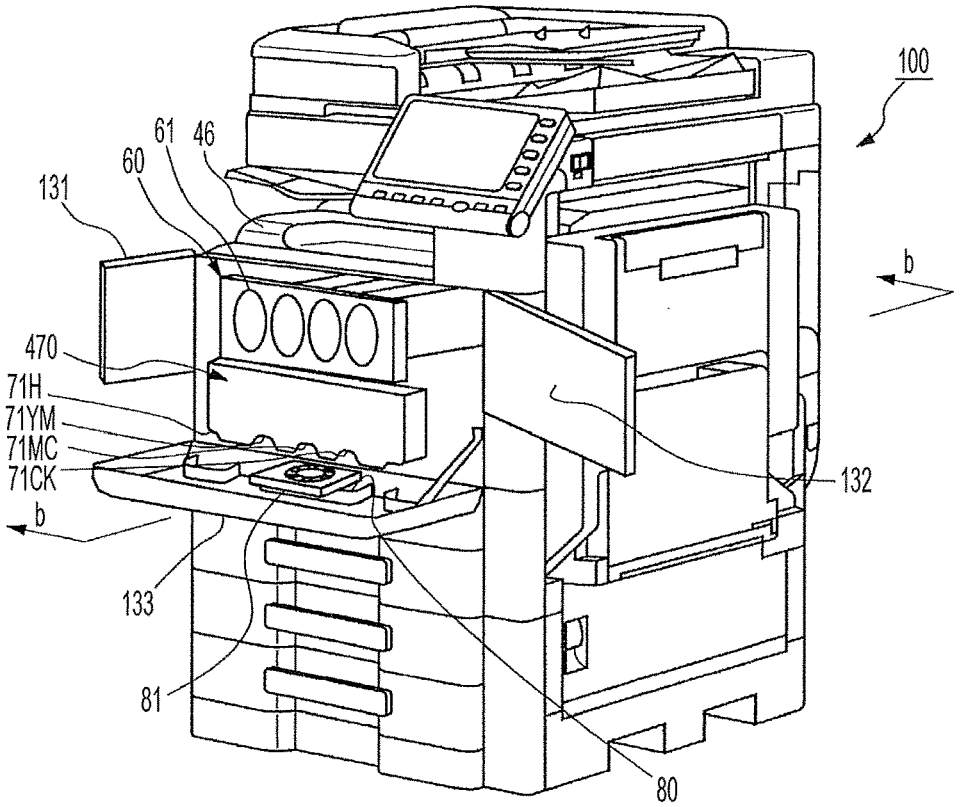
FIG. 8A is a perspective view illustrating an external view of a printer in which a fourth modified example of the toner collection container according to the embodiment of the present invention is incorporated.
Figure 8B:
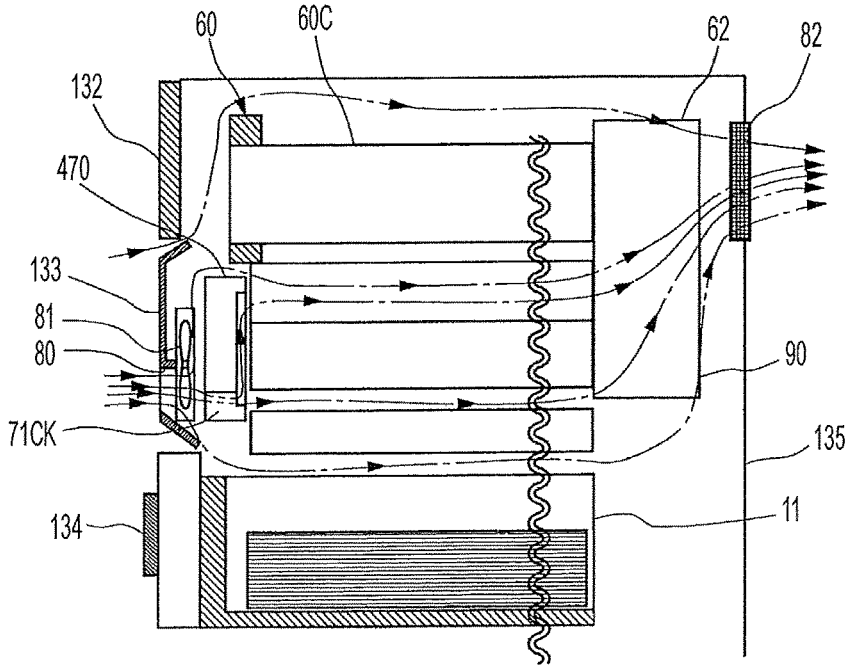
FIG. 8B is a schematic vertical cross-sectional view of the printer taken along a line b-b illustrated in FIG. 8A.

FIG. 8A is a perspective view illustrating an external view of the printer 130 in which a fourth modified example of the toner collection container 470 according to the embodiment of the present invention is incorporated, and FIG. 8B is a schematic vertical cross-sectional view of the printer 130 taken along a line b-b illustrated in FIG. 8A. In FIG. 8A, the front doors 131 to 133 of the body of the MFP 100 are opened, and therefore, the container 470 of the fourth modified example is visible from the outside. This container 470 differs from the container 70 of the above-described embodiment in that a recess on the bottom surface constitutes a duct. Since other elements are similar, the duct will be described below, and as for other elements, the description of the above embodiment will be used.

With rotation of the fan 81, the external air is introduced into the inside of the body from the air inlet port 80, and the air inside the body is exhausted to the outside from the air outlet port 82. With this structure, airflows directed from the air inlet port 80 toward the air outlet port 82 are generated in a space inside the body, as indicated by one-dot chain lines in FIG. 8B. These airflows mainly pass through the space surrounded by the intermediate transfer belt 23 and the gap between the exposure unit 27 and the image forming units 21Y to 21K, and flow into the drive unit 90. Since the airflow thus flows from the air inlet port 80 to the air outlet port 82, ozone generated due to discharge at the electric charger 26 is released to the external air, and the motor and the control circuit included in the drive unit 90 and the exposure unit 27 are cooled.

As illustrated in FIGS. 8A and 8B, the toner collection container 470 is incorporated in the gap between the air inlet port 80 and the image former 20. The gap between the container 470 and members surrounding the same, such as the replenishing unit 60, is narrow. However, this container 470 has three ducts 71YM, 71MC, and 71CK on the bottom surface, and has an end 71H in the longitudinal direction of the bottom surface recessed in a round shape. All of the ducts 71YM to 71CK are portions included in the bottom surface of the container 470 and recessed toward the storing region, and extend from the side where the air inlet port 80 is positioned to the side where the image former 20 is positioned. With this structure, each of the ducts 71YM to 71CK guides, in cooperation with the end 71H of the bottom surface, the external air flowing from the air inlet port 80 to the space surrounded by the intermediate transfer belt 23 and to the gap between the exposure unit 27 and the image forming units 21Y to 21K. Since the ducts 71YM to 71CK thus function as ventilation passages, a large amount of the external air flowing from the air inlet port 80 into the drive unit 90 through the image former 20 is secured despite a fact that the gap around the toner collection container 470 is narrow. As a result, even in a case where the toner collection container 470 blocks a large part of the space inside the front door 133, both of the effect of removing ozone from the image former 20 by ventilation and the effect of cooling the drive unit 90 and the exposure unit 27 are sufficiently high.

Figure 9A:
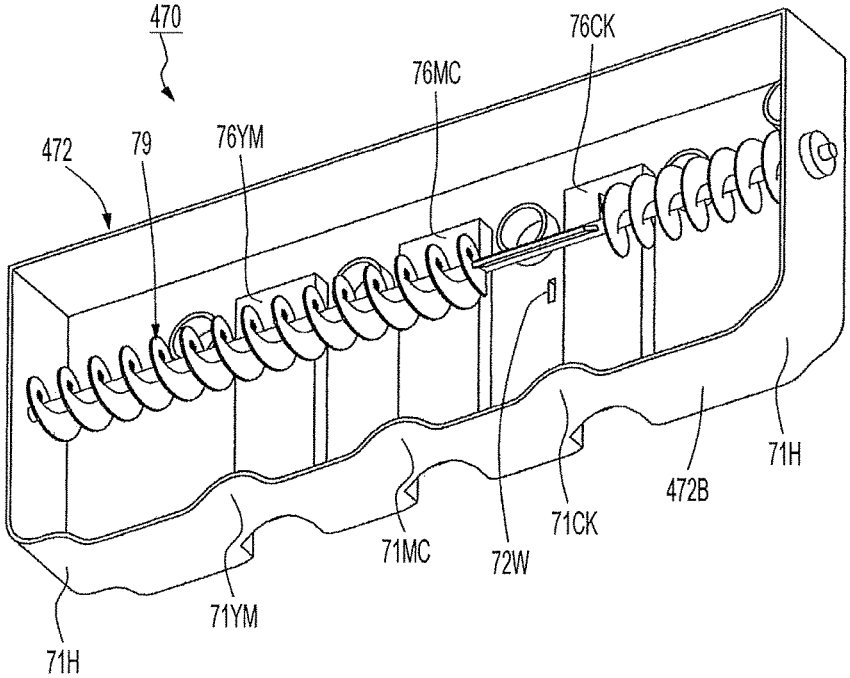
FIG. 9A is a perspective view illustrating an external view from a position where a front face of the toner collection container according to the fourth modified example is visible.
Figure 9B:
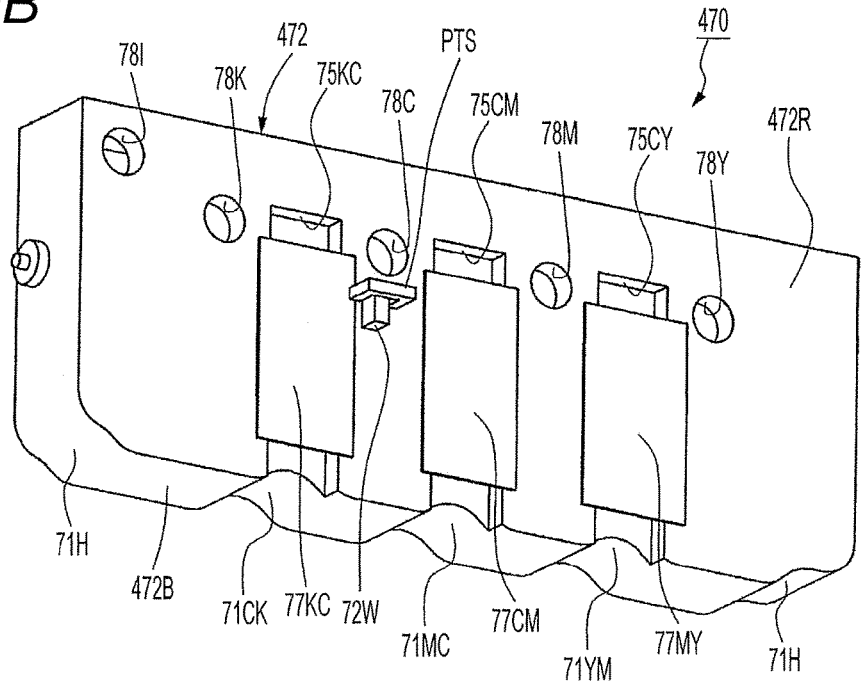
FIG. 9B is a perspective view illustrating an external view from a position where a rear face thereof is visible.
Figure 10A:
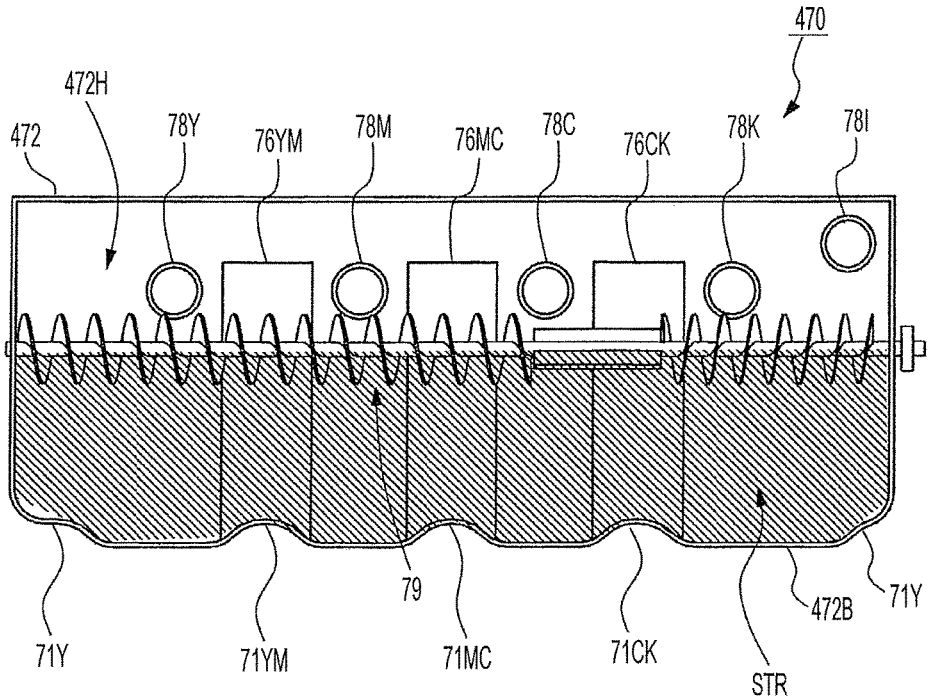
FIG. 10A is a front view of the container illustrated in FIG. 9A.
Figure 10B:
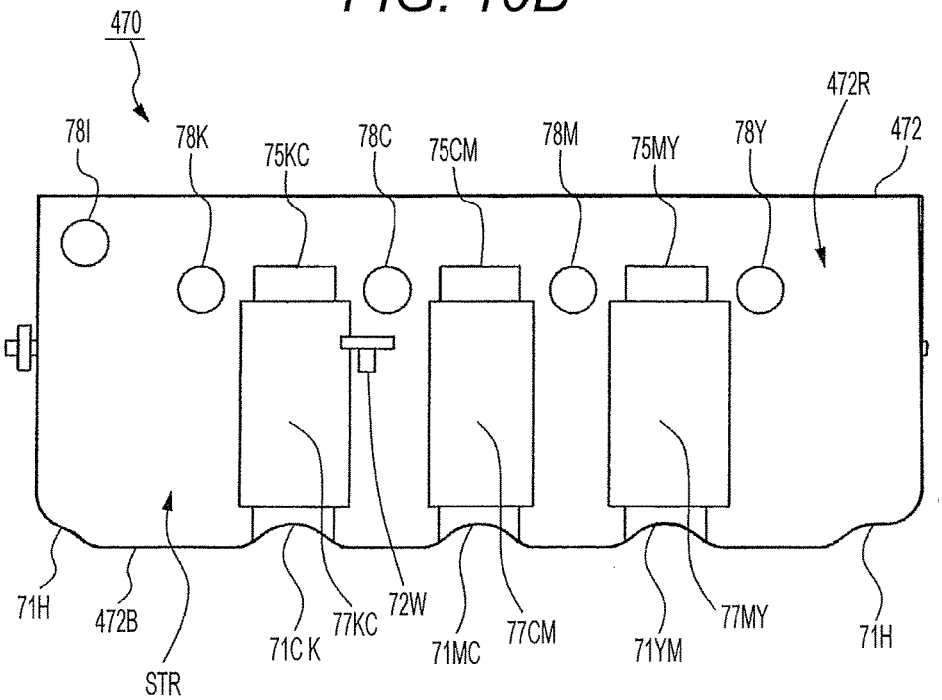
FIG. 10B is a rear view of the container illustrated in FIG. 9B.

FIG. 9A is a perspective view illustrating an external view from a position where a front face of the toner collection container 470 of the fourth modified example is visible, and FIG. 9B is a perspective view illustrating an external view from a position where a rear face thereof is visible. In FIG. 9A, the entire front face of the container 470 is removed, and an internal structure of the container 470 is visible. FIG. 10A is a front view of the container 470 illustrated in FIG. 9A, and FIG. 10B is a rear view of the container 470 illustrated in FIG. 9B. As illustrated in FIGS. 9A, 9B, 10A, and 10B, all of ducts 71YM to 71CK are hollow grooves provided at a bottom surface 472B of a housing 472 of the container 470, and extend perpendicular to the longitudinal direction of the housing 472, and the grooves each have a uniform radius in an entire part thereof. The ducts 71YM to 71CK are respectively positioned in the middle positions between the single color toner receiving ports 78Y to 78K in the longitudinal direction of the housing 472, and guide the external air introduced by the fan 81 to the image forming units 21Y to 21K, respectively. In FIGS. 9A, 9B, 10A, and 10B, all of the ducts 71YM to 71CK have equal cross-sectional areas. However, similar to the ducts 71Y to 71K according to the above-described embodiment, the cross-sectional areas may be different in accordance with a difference between required ventilation amounts in the image forming units 21Y to 21K.

As illustrated in FIGS. 9B and 10B, three vertical holes 75KC, 75CM, and 75MY are opened on a rear wall 472R of the housing 472. Each of the vertical holes 75KC to 75MY has a rectangle shape long in a short side direction of the rear wall 472R, and lower ends thereof are connected to the ducts 71YM to 71CK. On the other hand, as illustrated in FIGS. 9A and 10A, vertical walls 76YM, 76MC, and 76CK block inner sides of the vertical holes 75MY, 75CM, and 75KC, and isolate a hollow 472H of the housing 472 from the outside, and also secure gaps inside the respective vertical holes. A region between an upper end and a lower end of each of the vertical holes 75YM to 75CK are blocked from the outside by each of thin plate-like members 77YM, 77MC, and 77CK made of a resin, for example. With this structure, respective gaps between the vertical walls 76YM to 76CK and the plate-like members 77YM to 77CK function as guide passages to guide airflows flown from the fan 81 to the upper ends of the vertical holes 75YM to 75CK from the ducts 71YM to 71CK, respectively. Since these upper ends face the space surrounded by the intermediate transfer belt 23, the airflows having passed through the ducts 71YM to 71CK are also branched into the guide passages (vertical walls) 76YM to 76CK, and released to the space surrounded by the intermediate transfer belt 23. With this structure, the air cooling effect for the motor of the drive unit 90 and the like can be highly maintained.

In a manufacturing process of the toner collection container 470, the ducts 71YM to 71CK are integrally molded with the housing 472. The bottom surface 472B has elasticity higher than that in other surfaces of the housing 472 because of the presence of the ducts 71YM to 71CK. Specifically, even in a case where the bottom surface 472B directly collides with a floor when a user mistakenly slips the container 470 out of the hand and drops the same on the floor at the time of replacing the container 470, impact force from the floor is absorbed by elastic change in the recesses of the ducts 71YM to the 71CK. As a result, the bottom surface 472B is prevented from being damaged, such as dented or cracked, even though direct impact is received from the floor.

(G) In FIGS. 3A, 3B, 4A, and 4B, the housing 72 of the toner collection container 70 has the length in one direction longer than that in another direction, and the ducts 71Y to 71K are arranged orthogonal to the longitudinal direction of the housing 72. The reason is that: as illustrated in FIGS. 2A and 2B, the air inlet port 80 and the fan 81 of the MFP 100 are positioned, with respect to the housing 72, in a direction orthogonal to the longitudinal direction of the housing 72. Different from this, in a case where an air inlet port and a fan of an MFP are positioned, with respect to a toner collection container, in a longitudinal direction of a housing thereof, a duct may extend in the longitudinal direction thereof.

Figure 11:
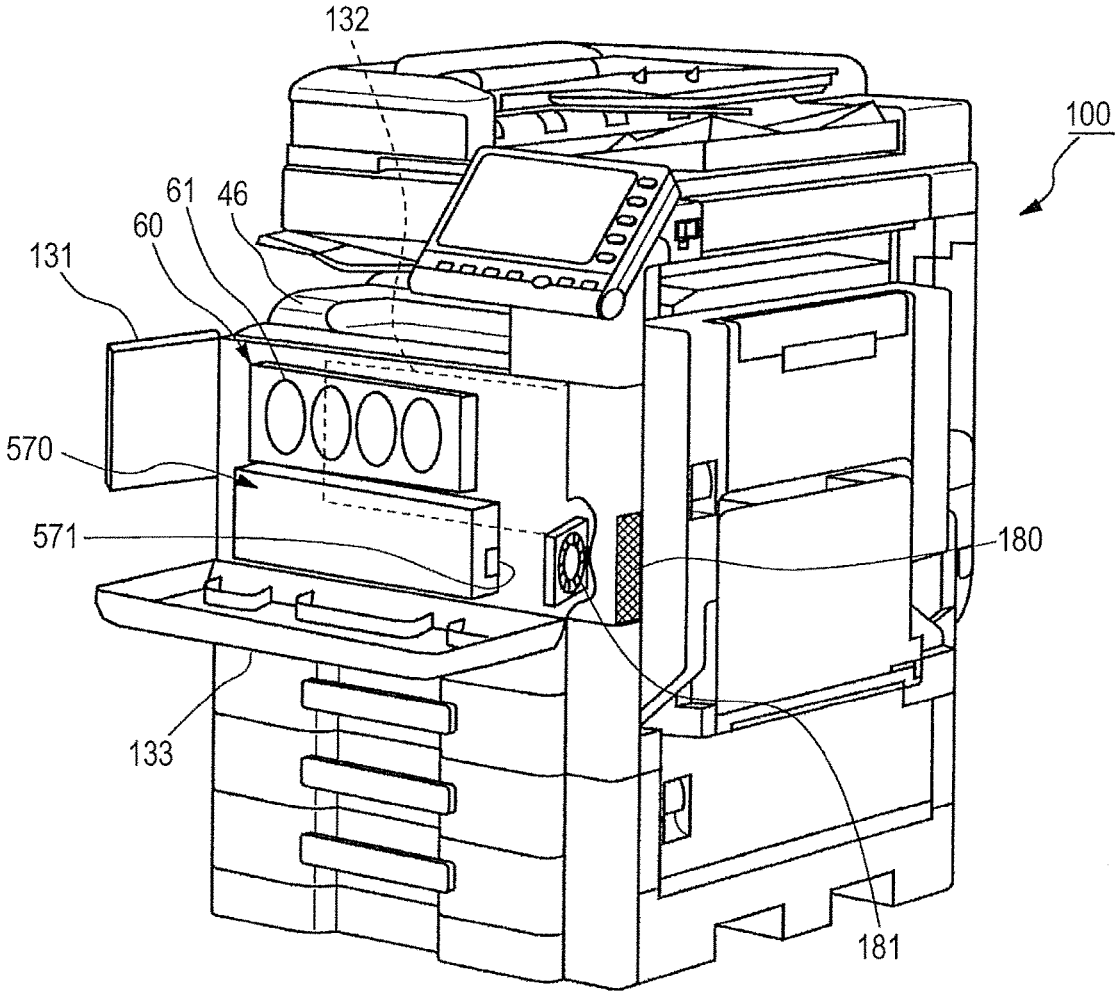
FIG. 11 is a perspective view illustrating an external view of a printer in which a fifth modified example of the toner collection container according to the embodiment of the present invention is incorporated.

FIG. 11 is a perspective view illustrating an external view of the printer 130 in which a fifth modified example of a toner collection container 570 according to the embodiment of the present invention is incorporated. In FIG. 11, the front doors 131 to 133 of the body of the MFP 100 are opened, and therefore, the container 570 of the fifth modified example is visible from the outside. This container 570 differs from the container 70 of the above embodiment in a structure of a duct. Since other elements are similar, the duct will be described below, and as for other elements, the description of the above embodiment will be used.

An air inlet port 180 is a hole opened like a mesh on a side of the front door 133 out of side surfaces of the body of the MFP 100, and provides communication between an inner space of the body and the outside thereof. A fan 181 is installed inside the side surface of the body, particularly, in a deeper side of the air inlet port 180. With rotation of the fan 181, external air is introduced into the inside of the body from the air inlet port 180. On the other hand, air inside the body is exhausted to the outside from the air outlet port 82 positioned on the rear face of the body illustrated in FIGS. 2A and 2B. With this structure, airflows directed from the air inlet port 180 to the air outlet port 82 are generated in a space inside the body. Similar to the airflows illustrated in FIG. 2B, these airflows mainly pass through the space surrounded by the intermediate transfer belt 23 and the gap between the exposure unit 27 and the image forming units 21Y to 21K in the image former 20, and flow into the drive unit 90. The airflow having passed through the drive unit 90 escapes from the air outlet port 82 to the external air. Since the airflow thus flows from the air inlet port 180 to the air outlet port 82, ozone generated due to discharge at the electric charger 26 is released to the external air, and the motor and the control circuit included in the drive unit 90 and the exposure unit 27 are cooled.

As illustrated in FIG. 11, the toner collection container 570 of the fifth modified example is incorporated in a gap between the front door 133 of the body and the image former 20. The gap between the container 570 and members surrounding the same, such as the replenishing unit 60, is narrow. However, one duct 571 extends in the longitudinal direction of the housing on the rear face of the container 570. The duct 571 includes openings on both side surfaces and the rear face of the container 570, and guides external air flowing from the air inlet port 180 from an opening positioned on the side surfaces of the container 570 to an opening positioned on the rear face, thereby moving the external air to the space surrounded by the intermediate transfer belt 23. Since the duct 571 thus functions as a ventilation passage, a large amount of the external air flowing into the drive unit 90 from the air inlet port 180 through the image former 20 is secured despite a fact that the gap around the container 570 is narrow. As a result, even in a case where the toner collection container 570 blocks a large part of the space inside the front door 133, both of the effect of removing ozone from the image former 20 by ventilation and the effect of cooling the drive unit 90 and the exposure unit 27 are sufficiently high.

Figure 12A:
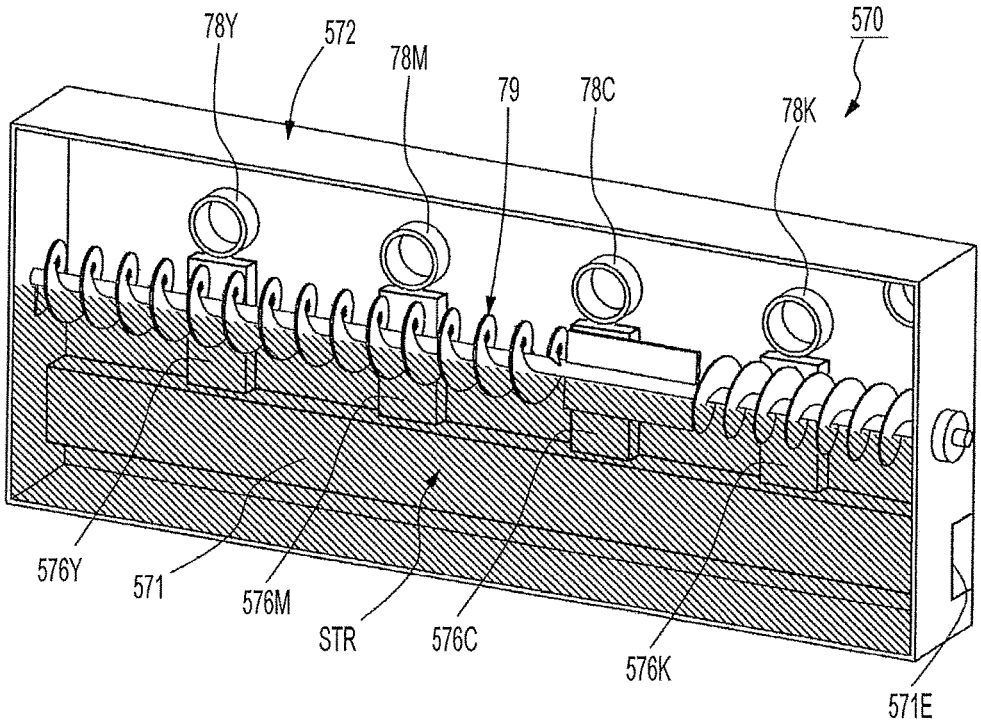
FIG. 12A is a perspective view illustrating an external view from a position where a front face of the toner collection container according to the fifth modified example is visible.
Figure 12B:
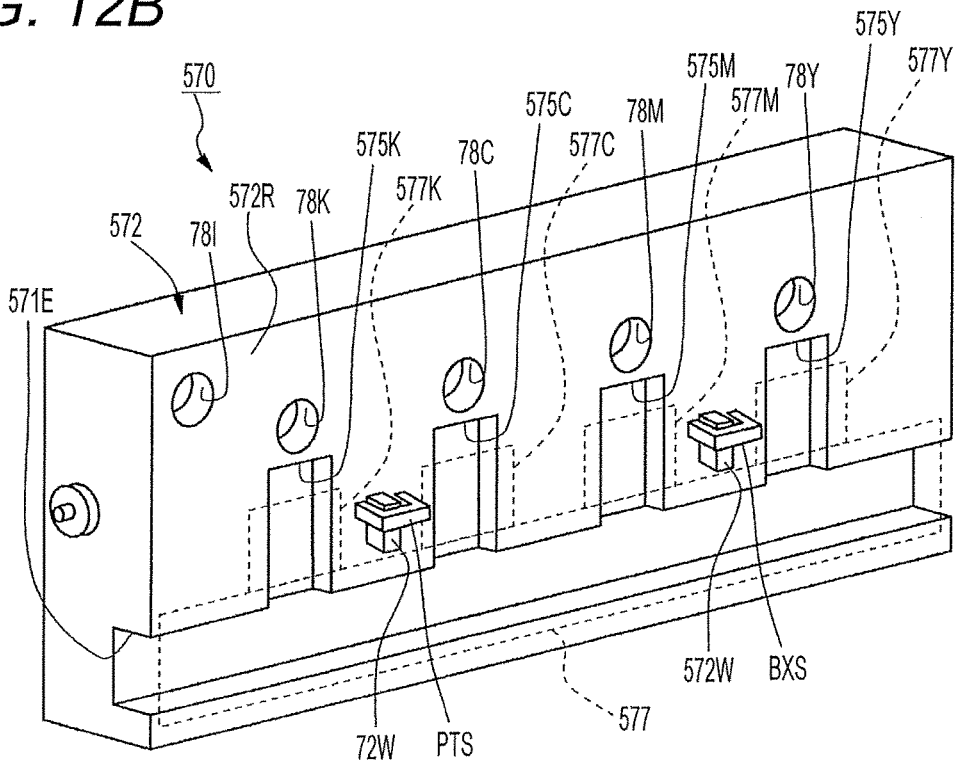
FIG. 12B is a perspective view illustrating an external view from a position where a rear face thereof is visible.

FIG. 12A is a perspective view illustrating an external view from a position where a front face of the toner collection container 570 of the fifth modified example is visible, and FIG. 12B is a perspective view illustrating an external view from a position where a rear face thereof is visible. In FIG. 12A, the entire front face of the container 570 is removed, and an internal structure of the container 570 is visible. As illustrated in FIGS. 12A and 12B, the duct 571 is a rectangular groove extending in a longitudinal direction of a housing 572 in a region included in a rear wall 572R of the housing 572 of the container 570 and facing the storing region STR, and has a width and a depth which are uniform in an entire part thereof. Both ends of the duct 571 are connected to rectangular holes 571E opened on both side surfaces of the housing 572. The duct 571 is further blocked by a thin plate-like member 577 made of a resin, for example, from the rear face side of the housing 572. With this structure, an airflow sent from the fan 181 flows into the duct 571 from the hole 571E on one side surface of the housing 572, passes through the duct 571, and is flows out from the other hole on the opposite side surface of the housing 572.

As illustrated in FIG. 12B, four vertical holes 575Y, 575M, 575C, and 575K are opened on the rear wall 572R of the housing 572. Each of the vertical holes 575Y to 575K has rectangle shape having a long length in a short side direction of the rear wall 572R, and has a lower end connected to the duct 571. On the other hand, as illustrated in FIG. 12A, vertical walls 576Y, 576M, 576C, and 576K block the inner side of the vertical holes 575Y to 575K, and isolate a hollow 572H of the housing 572 from the outside, and also secure gaps in the respective vertical holes. A region between an upper end and a lower end of each of the vertical holes 575Y to 575K is blocked from the outside by each of thin plate-like members 577Y, 577M, 577C, and 577K each made of a resin, for example. With this structure, respective gaps between the vertical walls 576Y to 576K and the plate-like members 577Y to 577K function as guide passages to guide the airflow passing through the duct 571 to the upper ends of the vertical holes 575Y to 575K. Since the upper ends thereof face the space surrounded by the intermediate transfer belt 23, the airflow passing through the duct 571 is also branched into the guide passages (vertical walls) 576Y to 576K and the plate-like members 577Y to 577K, and released to the space surrounded by the intermediate transfer belt 23. With this structure, the air cooling effect for the motor of the drive unit 90 and the like can be highly maintained.

In a manufacturing process of the toner collection container 570, the duct 571 is integrally molded with the housing 572. Due to the presence of the duct 571, the rear wall 572R of the housing 572 has rigidity higher than that in other surfaces of the housing 572. In other words, the duct 571 prevents deflection of the rear wall 572R in the longitudinal direction of the housing 572 caused by a weight of waste toner. As a result, inside the printer 130, the position of the bay window 72W with respect to the toner sensor PTS is kept correctly on the light ray from the light emitter to the light receiver. Thus, a detection error by the toner sensor PTS is surely kept within the allowable range.

The rear wall 572R of the housing 572 illustrated in FIG. 12B further includes an actuator 572W. For example, the actuator 572W is a box-shaped protrusion similar to the bay window 72W. Inside the printer 130, the actuator 572W contacts a sensor BXS to detect the toner collection container provided in the printer 130. The sensor BXS is, for example, a contact type mechanical switch or a strain gauge type pressure sensor, and detects attachment of the toner collection container 570 on the basis of a state change from OFF to ON of a switch or stress increase caused by contact of the actuator 572W.

The vicinity of the actuator 572W has rigidity higher than that in other surfaces of the housing 572 due to the presence of the duct 571 in a manner similar to the vicinity of the bay window 72W. In other words, the duct 571 prevents deflection of the rear wall 572R in the longitudinal direction of the housing 572 caused by the weight of waste toner. As a result, inside the printer 130, the actuator 572W contacts the sensor BXS at the correct position. Thus, a detection error of attachment of the housing 572 by the sensor BXS is surely maintained within the allowable range.

The present invention relates to a toner collection container provided in an image forming device, and a member penetrating a storing region in the housing or a duct formed as a recess at a bottom surface of the housing is formed in the housing of the container as described above. Thus, the present invention is obviously industrially applicable.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner collection container detachably incorporated in an electrophotographic image forming device in order to collect toner to be discarded from an image former of the image forming device, the toner collection container comprising:

a housing including a hollow capable of storing discarded toner, and incorporated between an air inlet port and the image former in a space surrounded by a chassis of the image forming device, the air inlet port introducing external air into the space; and at least one duct being formed of a cylindrical or tubular member that penetrates a storing region in the hollow of the housing from a side closer to the air inlet port to a side closer to the image former out of side walls of the housing, or formed of a recess included in a bottom surface of the housing and recessed toward the storing region, the storing region actually storing the toner, and the duct guiding external air flowing from the air inlet port to a side where the image former is positioned.

2. The toner collection container according to claim 1, wherein a part included in side walls of the housing and facing the storing region, or a bottom surface of the housing has strength higher than strength in other parts of the housing due to presence of the duct.

3. The toner collection container according to claim 1, further comprising a leveling member that is a movable member extending in a direction horizontal to the hollow of the housing, and levels toner stored in the hollow with an action of the leveling member, wherein the duct is installed closer to a bottom surface of the storing region than the leveling member is.

4. The toner collection container according to claim 1, wherein in a case where the image forming device includes a plurality of image formers, the number of ducts is equal to the number of the image formers.

5. The toner collection container according to claim 4, wherein different ducts guide external air to different image formers, respectively, and the more frequently an image former is used, the larger cross-sectional area a duct has.

6. The toner collection container according to claim 1, wherein the housing includes a window in a region facing a toner sensor included in the image forming device when the housing is incorporated in the image forming device, and the window causes the toner sensor to detect toner stored in the hollow, and a vicinity of the window in the housing has rigidity higher than rigidity in other parts due to presence of the duct.

7. The toner collection container according to claim 6, wherein a duct located closest to the window among the ducts has a cross-sectional area smaller than cross-sectional areas of other ducts.

8. The toner collection container according to claim 1, wherein the housing includes a region facing a sensor that detects a toner collection container and is included in the image forming device when the housing is incorporated in the image forming device, and the region has rigidity higher than rigidity in other parts due to presence of the duct.

9. The toner collection container according to claim 1, wherein the housing has a longer length in one direction than in another direction, and the duct is orthogonal to a longitudinal direction of the housing.

10. The toner collection container according to claim 9, wherein the duct is a cylindrical member penetrating the storing region of the housing, or the duct is a hollow groove provided at the bottom surface of the housing.

11. The toner collection container according to claim 1, wherein the housing has a longer length in one direction than in another direction, and the duct extends in a longitudinal direction of the housing.

12. The toner collection container according to claim 1, wherein the housing further includes at least one guide passage that guides, in a desired direction, external air having passed through the duct.

13. The toner collection container according to claim 12, wherein the number of ducts and the number of guide passages are the same, and different guide passages are connected to different ducts, respectively, and the housing further includes a communication passage that provides communication between the different guide passages.

14. An image forming device comprising:

a chassis including an air inlet port that introduces external air;

a conveyer that conveys a sheet in a space surrounded by the chassis;

an image former that forms an image on the sheet with toner; and a toner collection container according to claim 1, which is incorporated between the air inlet port and the image former in a space surrounded by the chassis, and collects toner to be discarded from the image former.

15. The image forming device according to claim 14, wherein at least one duct included in the toner collection container guides, to at least one of the conveyer and the image former, external air flowing from the air inlet port.

* * * * *